US009446599B2

(12) United States Patent
Will et al.

(10) Patent No.: US 9,446,599 B2
(45) Date of Patent: Sep. 20, 2016

(54) AUTOMATIC SUBLIMATED PRODUCT CUSTOMIZATION SYSTEM AND PROCESS

(71) Applicant: The Hillman Group, Inc., Cincinnati, OH (US)

(72) Inventors: Gary Edward Will, Gold Canyon, AZ (US); Mark Leslie Tarter, Mesa, AZ (US); Bryan Keith Solace, Chandler, AZ (US); James Francis Huss, Scottsdale, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 0 days.

(21) Appl. No.: 14/815,489

(22) Filed: Jul. 31, 2015

(65) Prior Publication Data

US 2015/0336395 A1 Nov. 26, 2015

Related U.S. Application Data

(63) Continuation of application No. 13/951,175, filed on Jul. 25, 2013, now Pat. No. 9,120,326.

(51) Int. Cl.

| | |
|---|---|
| ***B41M 5/035*** | (2006.01) |
| ***B41F 16/00*** | (2006.01) |
| ***B41J 2/325*** | (2006.01) |

(Continued)

(52) U.S. Cl.

CPC ..... *B41J 2/315* (2013.01); *B41F 16/008* (2013.01); *B41F 16/0046* (2013.01); *B44C 1/16* (2013.01); *G07G 1/00* (2013.01); *B41F 16/00* (2013.01);

(Continued)

(58) Field of Classification Search

CPC combination set(s) only.

See application file for complete search history.

(56) References Cited

U.S. PATENT DOCUMENTS

| | | | |
|---|---|---|---|
| 4,059,471 | A | 11/1977 | Haigh |
| 4,174,250 | A | 11/1979 | Durand |

(Continued)

FOREIGN PATENT DOCUMENTS

| | | |
|---|---|---|
| DE | 10 1011 012833 A1 | 9/2012 |
| EP | 2000303 | 10/2008 |

(Continued)

OTHER PUBLICATIONS

European Patent Office, International Search Report for PCT Application No. PCT/US2014/047527, Feb. 12, 2015, 3 pages.

(Continued)

*Primary Examiner* — Huan Tran

(74) *Attorney, Agent, or Firm* — Finnegan, Henderson, Farabow, Garrett & Dunner, LLP

(57) ABSTRACT

An automatic product sublimation process is disclosed allowing for point-of-sale customization of sublimation parameters in a retail environment. A dye sublimation transfer printing system is configured to print one or more images onto transfer media, then position the media onto a substrate. A selected product is positioned on top of the media. The system is configured to automatically determine, by a processor, one or more of a temperature and duration of a single thermal cycle to sublimate the one or more images onto the selected product. The determination may be based on properties of the product, characteristics of the images, or both. One or more heating platens engage the transfer media to sublimate the product in a single thermal cycle, wherein at least one of the cycle's temperature and duration match the determined values. The disclosed process improves the quality of the sublimation technique, yet requires no substantive operator training.

20 Claims, 13 Drawing Sheets

(51) Int. Cl.

| | |
|---|---|
| ***B41J 2/315*** | (2006.01) |
| ***B44C 1/16*** | (2006.01) |
| ***G07G 1/00*** | (2006.01) |
| *B41J 2/32* | (2006.01) |

(52) U.S. Cl.

CPC . *B41J 2/32* (2013.01); *B41J 2/325* (2013.01); *B41M 5/035* (2013.01)

(56) References Cited

U.S. PATENT DOCUMENTS

| | | | |
|---|---|---|---|
| 4,202,663 | A | 5/1980 | Haigh et al. |
| 4,242,092 | A | 12/1980 | Glover |
| 4,253,838 | A | 3/1981 | Mizuno et al. |
| 4,314,814 | A | 2/1982 | Deroode |
| 4,465,728 | A | 8/1984 | Haigh et al. |
| 4,662,966 | A | 5/1987 | Sumi et al. |
| 4,664,672 | A | 5/1987 | Krajec et al. |
| 4,670,084 | A | 6/1987 | Durand |
| 4,933,315 | A | 6/1990 | Kanto et al. |
| 4,943,555 | A | 7/1990 | Nakamoto et al. |
| 4,990,485 | A | 2/1991 | Egashira et al. |
| 5,122,499 | A | 6/1992 | Janssens et al. |
| 5,135,905 | A | 8/1992 | Egashira et al. |
| 5,202,176 | A | 4/1993 | Higuchi et al. |
| 5,244,234 | A | 9/1993 | Oshima et al. |
| 5,246,518 | A | 9/1993 | Hale |
| 5,248,363 | A | 9/1993 | Hale |
| 5,252,530 | A | 10/1993 | Nakamura |
| 5,254,523 | A | 10/1993 | Fujimura et al. |
| 5,302,223 | A | 4/1994 | Hale |
| 5,308,426 | A | 5/1994 | Claveau |
| 5,344,807 | A | 9/1994 | Nakamura |
| 5,346,877 | A | 9/1994 | Nakamura |
| 5,354,401 | A | 10/1994 | Asahi et al. |
| 5,431,501 | A | 7/1995 | Hale et al. |
| 5,432,145 | A | 7/1995 | Oshima et al. |
| 5,468,714 | A | 11/1995 | Oshima et al. |
| 5,487,614 | A | 1/1996 | Hale |
| 5,488,907 | A | 2/1996 | Xu et al. |
| 5,522,317 | A | 6/1996 | Hale et al. |
| 5,546,316 | A | 8/1996 | Buckley et al. |
| 5,550,098 | A | 8/1996 | Aso et al. |
| 5,555,813 | A | 9/1996 | Hale et al. |
| 5,575,877 | A | 11/1996 | Hale et al. |
| 5,580,410 | A | 12/1996 | Johnston |
| 5,590,600 | A | 1/1997 | Hale et al. |
| 5,601,023 | A | 2/1997 | Hale et al. |
| 5,623,581 | A | 4/1997 | Attenberg |
| 5,630,894 | A | 5/1997 | Koch et al. |
| 5,634,731 | A | 6/1997 | Kita et al. |
| 5,640,180 | A | 6/1997 | Hale et al. |
| 5,642,141 | A | 6/1997 | Hale et al. |
| 5,643,387 | A | 7/1997 | Berghauser et al. |
| 5,644,988 | A | 7/1997 | Xu et al. |
| 5,734,396 | A | 3/1998 | Hale et al. |
| 5,830,263 | A | 11/1998 | Hale et al. |
| 5,959,278 | A | 9/1999 | Kobayashi et al. |
| 5,962,368 | A | 10/1999 | Poole |
| 5,997,677 | A | 12/1999 | Zaher |
| 6,103,041 | A | 8/2000 | Wagner et al. |
| 6,105,502 | A | 8/2000 | Wagner et al. |
| 6,110,316 | A | 8/2000 | Kobayashi et al. |
| 6,118,545 | A | 9/2000 | Kawai et al. |
| 6,149,754 | A | 11/2000 | Ogata et al. |
| 6,165,938 | A | 12/2000 | Narita et al. |
| 6,249,297 | B1 | 6/2001 | Lion |
| 6,341,856 | B1 | 1/2002 | Thompson et al. |
| 6,344,103 | B1 | 2/2002 | Cheng et al. |
| 6,348,939 | B1 | 2/2002 | Xu et al. |
| 6,392,680 | B2 | 5/2002 | Akada et al. |
| 6,402,313 | B1 | 6/2002 | Xu et al. |
| 6,425,331 | B1 | 7/2002 | Xu et al. |
| 6,439,710 | B1 | 8/2002 | Hale et al. |
| 6,447,629 | B1 | 9/2002 | Thompson et al. |
| 6,450,098 | B1 | 9/2002 | Hale et al. |
| 6,474,230 | B2 | 11/2002 | Corrado |
| 6,486,903 | B1 | 11/2002 | Wagner et al. |
| 6,488,370 | B2 | 12/2002 | Hale et al. |
| 6,535,791 | B1 | 3/2003 | Wang |
| 6,540,345 | B1 | 4/2003 | Wagner et al. |
| 6,618,066 | B2 | 9/2003 | Hale et al. |
| 6,623,677 | B1 | 9/2003 | Smith et al. |
| 6,631,984 | B2 | 10/2003 | Thompson et al. |
| RE38,295 | E | 11/2003 | Kobayashi et al. |
| 6,649,317 | B2 | 11/2003 | Wagner et al. |
| 6,673,503 | B2 | 1/2004 | Wagner et al. |
| 6,686,314 | B2 | 2/2004 | Xu et al. |
| 6,814,831 | B2 | 11/2004 | Drake |
| 6,816,752 | B1 | 11/2004 | Wang |
| 6,840,614 | B2 | 1/2005 | Wagner et al. |
| 6,849,370 | B2 | 2/2005 | Wagner et al. |
| 6,887,640 | B2 | 5/2005 | Zhang et al. |
| 6,961,076 | B2 | 11/2005 | Wagner et al. |
| 6,966,643 | B2 | 11/2005 | Hale et al. |
| RE38,952 | E | 1/2006 | Hale et al. |
| 6,998,005 | B2 | 2/2006 | Magee et al. |
| 7,001,649 | B2 | 2/2006 | Wagner et al. |
| 7,041,424 | B2 | 5/2006 | Xu et al. |
| 7,137,426 | B2 | 11/2006 | Neri et al. |
| 7,154,630 | B1 | 12/2006 | Nimura et al. |
| 7,156,566 | B2 | 1/2007 | Johnson et al. |
| 7,166,191 | B2 | 1/2007 | Suzuki et al. |
| 7,212,308 | B2 | 5/2007 | Morgan |
| 7,267,737 | B2 | 9/2007 | Neri et al. |
| 7,524,048 | B2 | 4/2009 | Xu |
| 7,527,655 | B1 | 5/2009 | Wagner et al. |
| 7,563,341 | B2 | 7/2009 | Ferguson et al. |
| 7,654,660 | B2 | 2/2010 | Hale et al. |
| 7,810,538 | B2 | 10/2010 | Magee et al. |
| 7,870,824 | B2 | 1/2011 | Helma et al. |
| 8,029,883 | B2 | 10/2011 | Xu et al. |
| 8,268,546 | B2 | 9/2012 | Kobayashi et al. |
| 8,283,290 | B2 | 10/2012 | Langan et al. |
| 8,308,891 | B2 | 11/2012 | Drake et al. |
| 8,337,006 | B2 | 12/2012 | Hale et al. |
| 8,343,574 | B2 | 1/2013 | Downs et al. |
| 8,349,114 | B2 | 1/2013 | Green |
| 8,387,673 | B2 | 3/2013 | Spengler |
| 8,398,224 | B2 | 3/2013 | Hale et al. |
| 8,400,485 | B2 | 3/2013 | Hirota |
| 8,405,694 | B2 | 3/2013 | Hsu et al. |
| 8,425,029 | B2 | 4/2013 | Xu |
| 2004/0143914 | A1 | 7/2004 | Flaherty |
| 2005/0070434 | A1 | 3/2005 | Drake |
| 2005/0248649 | A1* | 11/2005 | Farrell et al. ..... 347/216 |
| 2007/0181253 | A1 | 8/2007 | Xu et al. |
| 2007/0213216 | A1* | 9/2007 | Lindemann et al. ..... 503/227 |
| 2008/0095940 | A1 | 4/2008 | Lee et al. |
| 2010/0129621 | A1 | 5/2010 | Langan et al. |
| 2010/0266817 | A1 | 10/2010 | Hirst |
| 2011/0111188 | A1 | 5/2011 | Xu et al. |
| 2011/0180202 | A1 | 7/2011 | Hirst et al. |
| 2012/0044312 | A1 | 2/2012 | Hirst |
| 2012/0219652 | A1 | 8/2012 | Simons |
| 2012/0297041 | A1 | 11/2012 | Momchilov |
| 2012/0301122 | A1 | 11/2012 | Chao et al. |
| 2012/0320136 | A1 | 12/2012 | Xu |
| 2012/0327257 | A1 | 12/2012 | O'Keefe et al. |
| 2013/0045341 | A1 | 2/2013 | Ramsden |
| 2015/0029285 | A1* | 1/2015 | Will et al. ..... 347/172 |
| 2015/0029288 | A1* | 1/2015 | Will et al. ..... 347/213 |

FOREIGN PATENT DOCUMENTS

| | | | |
|---|---|---|---|
| GB | 2 130 144 | A | 5/1984 |
| WO | WO 96/06729 | A1 | 3/1996 |
| WO | WO 97/09180 | A1 | 3/1997 |
| WO | WO 00/07822 | A1 | 2/2000 |
| WO | WO 2005/105470 | | 11/2005 |
| WO | WO 2008/144839 | | 12/2008 |
| WO | WO 2009/053721 | A1 | 4/2009 |

(56) References Cited

FOREIGN PATENT DOCUMENTS

| | | |
|---|---|---|
| WO | WO 2011/003125 | 1/2011 |
| WO | WO 2011/039785 | 4/2011 |
| WO | WO 2012/141985 A1 | 10/2012 |

OTHER PUBLICATIONS

European Patent Office, Written Opinion of the International Searching Authority for PCT Application No. PCT/US2014/047527, Feb. 12, 2015, 7 pages.
European Patent Office, International Search Report for PCT Application No. PCT/US2014/045719, Feb. 13, 2015, 3 pages.
European Patent Office, Written Opinion of the International Searching Authority for PCT Application No. PCT/US2014/045719, Feb. 13, 2015, 9 pages.
European Patent Office, International Search Report for PCT Application No. PCT/US2014/047142, Feb. 19, 2015, 3 pages.
European Patent Office, Written Opinion of the International Searching Authority for PCT Application No. PCT/US2014/047142, Feb. 19, 2015, 9 pages.
Office Action, U.S. Appl. No. 13/951,127, Mar. 17, 2015, 7 pages.
"Mug Sublimation," YouTube, http://www.youtube.com/watch?v=Xl_DB3TVAws, uploaded Jan. 21, 2008.
European Patent Office, International Search Report for PCT Application No. PCT/US2014/047396, Dec. 16, 2014, 6 pages.
European Patent Office, Written Opinion of the International Searching Authority for PCT Application No. PCT/US2014/047396, Dec. 16, 2014, 7 pages.
European Patent Office, International Search Report for PCT Application No. PCT/US2014/046944, Dec. 15, 2014, 6 pages.
European Patent Office, Written Opinion of the International Searching Authority for PCT Application No. PCT/US2014/046944, Dec. 15, 2014, 9 pages.
Office Action, U.S. Appl. No. 13/951,150, Jun. 19, 2015, 9 pages.
Office Action, U.S. Appl. No. 13/951,150, Oct. 28, 2015, 10 pages.
Office Action, U.S. Appl. No. 14/261,202, Sep. 21, 2015, 18 pages.

* cited by examiner

800

AUTOMATIC SUBLIMATED PRODUCT CUSTOMIZATION SYSTEM AND PROCESS

FIELD

The present disclosure generally relates to dye sublimation transfer printing, and more particularly, to a system and method suitable for a retail environment for automatically configuring a thermal cycle for the sublimation of an image onto a product selected by a consumer based on properties of the product or characteristics of the image.

BACKGROUND

Dye sublimation is a process employing heat and pressure to convert solid dyes into gaseous form without entering an intermediate liquid phase. Such a process can infuse colored dye into certain compatible materials, such as polyester or ceramics, to create a permanent printed image on the material.

Advances in printing technology and materials have made dye sublimation printing systems more accessible to the general public. Markets are developing for personalized, customized goods with sublimated graphics, but limitations of current printing solutions have prevented further integration and saturation within the marketplace. Safety is a concern, as many printing systems may present pinching hazards, expose users to potentially dangerous stored energy sources, and necessarily employ high levels of heat and pressure that could injure an untrained operator. Many systems also have large footprints that prevent ready deployment in a retail setting. Finally, the printing process can be complex, with multiple loading, aligning, and transporting steps. Development of a compact, automated sublimation printing system is needed in the art.

Several features are desirable in an integrated sublimation printing system designed for a retail environment. A versatile system capable of offering numerous sublimated products for customization would be valuable to the marketplace. Expediting, streamlining, and fully automating the printing and sublimation process would also increase efficiency and profitability. A key issue in designing and implementing such a system and process is that not all sublimated products are created equal. Various factors in a sublimation task might require alterations to the sublimation thermal cycle, including changes to the thermal cycle's temperature, duration, and pressure. Any number of criteria could implicate alterations in the thermal cycle, including the material comprising the sublimated product, the size of the product, the age and status of the system components, and even characteristics of the image to be sublimated. Failing to create an automated system to account for these variables results in either a "one-size-fits-all" thermal cycle that may result in misprinted or lower quality printed products, or a trial and error approach that is unsuited to a consumer environment. Each of these approaches results in frustrated customers, loss of goodwill and market opportunity, and significant wasted capital.

One attempt at a dye sublimation printer system capable of printing on multiple products in an industrial application is described in U.S. Pat. No. 8,308,891 (the '891 patent) issued to Drake, et al. on Nov. 13, 2012. The '891 patent is directed primarily towards sublimating images on plastic, though "metals, stone, wood, waxes, polymers, monomers, resins, textiles, fabrics, glasses, minerals, leather, and composites thereof" are also contemplated.

As a preliminary step, the system of the '891 patent fuses together a polymeric plastic product and a printed image sheet made of cellulosic paper treated with a plastic substance. The fusion occurs within a pressurized system. The plastic product and image sheet are kept under the same pressure as they are heated and cooled, resulting in the sublimation of the image from the image sheet onto the product. The heating temperature and duration are based on "optimal" conditions "empirically" determined, apparently by trial and error, for the given plastic product. The product and the image sheet are then separated.

Although the systems and methods disclosed in the '891 patent may assist an operator in sublimating onto various products, the disclosed system is limited. Although a conveyor belt system is disclosed, the '891 system does not otherwise easily lend itself to streamlined automation. No integrated system is disclosed, and there is no capability for an untrained user to operate the system. The '891 system requires laborious empirical optimization of temperature and duration of a thermal cycle, and constant monitoring of the complex process. These limitations render the system of '891 patent unsuitable for a consumer-oriented system in the retail environment.

The disclosed system is directed to overcoming one or more of the problems set forth above and/or elsewhere in the prior art. The disclosed system is intended to satisfy the need for a point-of-sale customization approach in retail-oriented sublimation systems.

SUMMARY

The present invention is directed to an improved automatic sublimated product customization system and process. The advantages and purposes of the invention will be set forth in part in the description which follows, and in part will be apparent from the description, or may be learned by practice of the invention. The advantages and purposes of the invention will be realized and attained by the elements and combinations particularly pointed out in the appended claims.

In accordance with one aspect of the invention, an automated system for sublimating an image on a product selected from a plurality of different products is disclosed. The system comprises a dye sublimation transfer printer which is electronically configured to receive a digital image file representing an image, and configured to print the received image on a transfer media. The system further comprises a substrate configured to receive the transfer media. The system includes one or more heating platens configured to engage the transfer media and sublimate the printed image onto one or more surfaces of the selected product in a thermal cycle, the thermal cycle including a predetermined temperature and duration. Finally, the system comprises an interface device including one or more processors, wherein the interface device is configured to automatically determine one or more of the temperature and duration of the thermal cycle based upon one or more properties of the selected product.

In another aspect, the invention is directed to an automated computer-implemented method for sublimating an image on a product selected from a plurality of different products. The method comprises the steps of printing one or more images on a transfer media, and positioning the transfer media on a substrate. The method includes positioning a product selected from a plurality of different products onto the transfer media. The method further includes determining, by a processor, at least one value corresponding to one or more of a temperature and a duration of a thermal cycle to sublimate the one or more images from the transfer media onto the selected product, wherein the determination is made based on at least one of a property of the selected product or a characteristic of the one or more images. Additionally, the method comprises moving one or more heating platens into contact with the transfer media, and sublimating the one or more images from the transfer media to the product, wherein at least one of the temperature and duration of the thermal cycle are the values determined by the processor.

In yet another aspect, the invention is directed to an automated vending system for sublimating an image on a product selected by a user from a plurality of different products is disclosed. The vending system comprises a dye sublimation transfer printer which is electronically configured to receive a digital image file representing an image from the user, and configured to print the received image on a transfer media. The vending system further comprises a substrate configured to receive the transfer media in a predetermined orientation. Additionally, the vending system includes a storage compartment configured to store a plurality of products of different types. The vending system further comprises a transport mechanism configured to position a product selected by the user onto the transfer media. The vending system includes one or more heating platens configured to engage the transfer media and sublimate the printed image onto one or more surfaces of the selected product in a single thermal cycle, the single thermal cycle including a temperature and duration. Also, the vending system includes a housing substantially enclosing the dye sublimation transfer printer, substrate, storage compartment, transport mechanism, and one or more heating platens in a manner that prevents a user from contacting the enclosed components. Finally, the system comprises an interface device including one or more processors, wherein the interface device is configured to allow the user to select a product from the storage compartment and automatically determine one or more of the temperature and duration of the thermal cycle based upon one or more properties of the selected product.

In still another aspect, the invention is directed to an automated computer-implemented method for sublimating an image on a product selected from a plurality of different products contained within a storage compartment. The method comprises selecting the product from a plurality of products of different types contained within a storage compartment, the plurality of products each comprised of a material capable of incorporating sublimation dye. The method further includes the steps of printing one or more images identified by a customer on a transfer media, and positioning the transfer media on a substrate. The method includes positioning the selected product onto the transfer media. The method further includes determining, by a processor, at least one value corresponding to one or more of a temperature and a duration of a thermal cycle to sublimate the one or more images from the transfer media onto the product, wherein the determination is made based upon one or more properties of the selected product. Additionally, the method comprises moving a heating platen into contact with the transfer media, and sublimating the one or more images from the transfer media to the product, wherein at least one of the temperature and duration of the thermal cycle are the values determined by the processor.

Additional objects and advantages of the invention will be set forth in part in the description which follows, and in part will be apparent from the description, or may be learned by practice of the embodiments. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments and aspects of the disclosed embodiments and, together with the description, serve to explain the principles of the disclosed embodiments. In the drawings.

DETAILED DESCRIPTION

Reference will now be made in detail to various embodiments, examples of which are illustrated in the accompanying drawings. Wherever possible, the same reference numbers will be used throughout the drawings to refer to the same or like parts.

Figure 1:
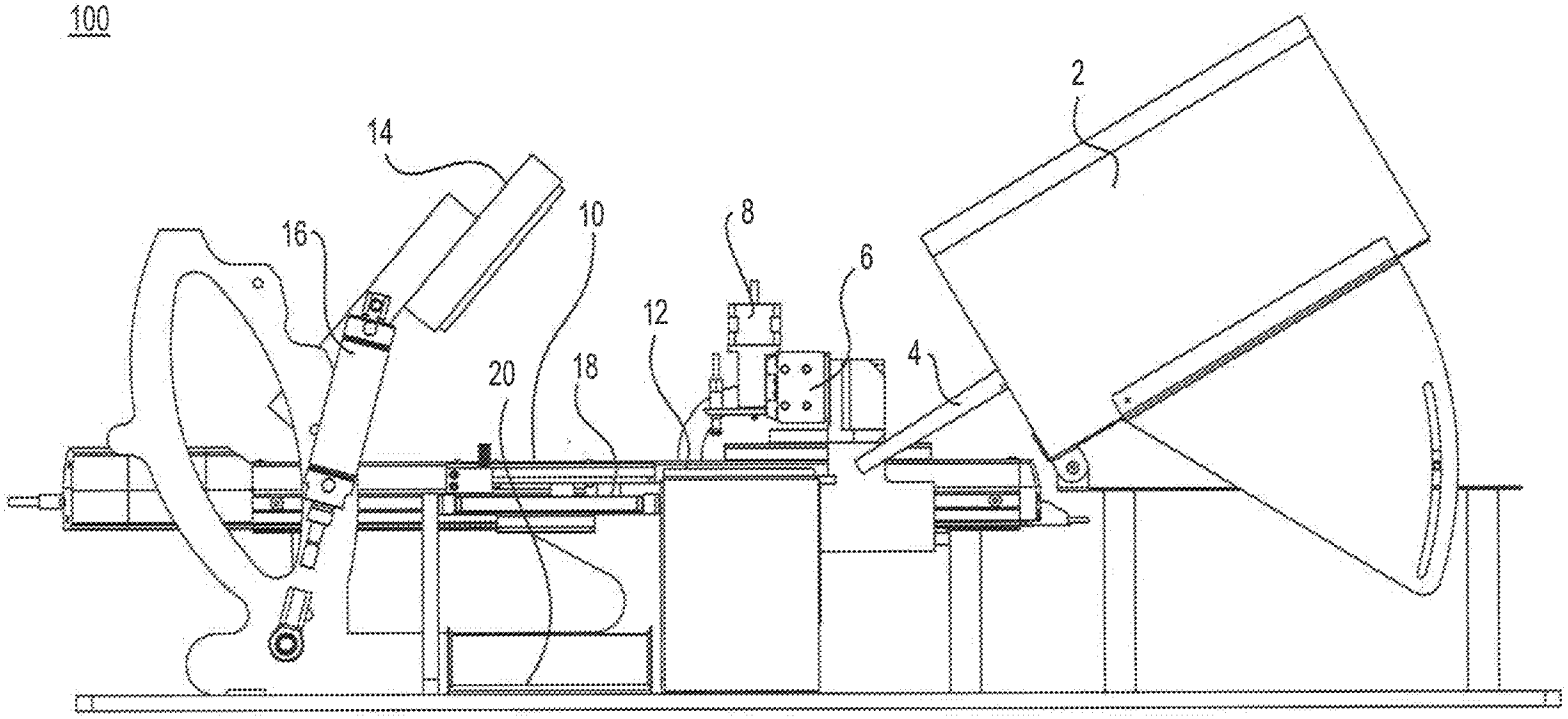
FIG. 1 is a front view of an exemplary dye sublimation transfer printing system consistent with disclosed embodiments.
Figure 2:
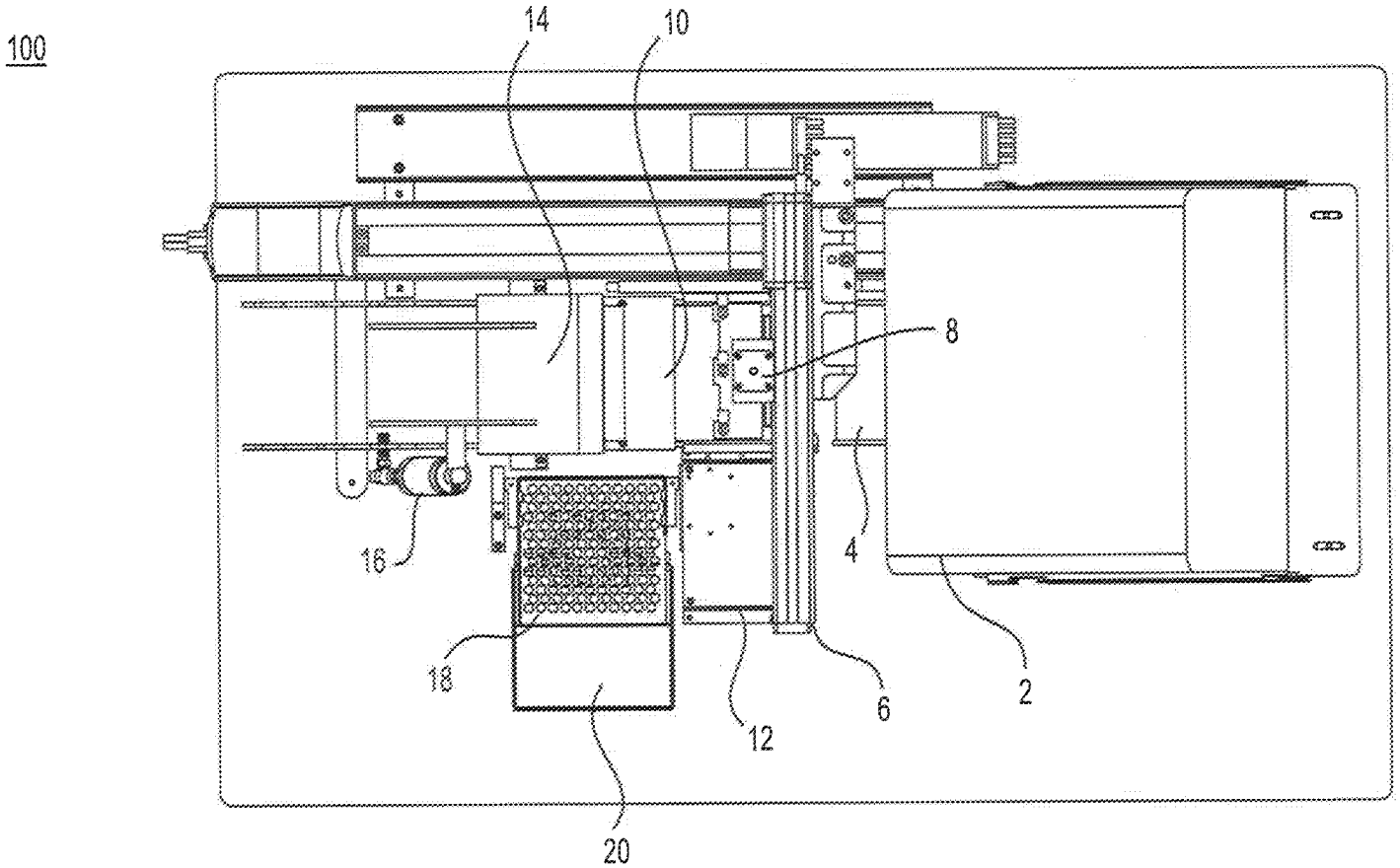
FIG. 2 is a top view of the dye sublimation transfer printing system of FIG. 1.

FIGS. 1 and 2 illustrate an exemplary dye sublimation transfer printing system 100. System 100 may contain various modules configured to complete printing and sublimation tasks. As used herein, "module" is not used in a manner requiring a completely separate modular arrangement. Rather, "module" is used more generally to refer to the components necessary to provide the required functionality. In effect, the noted modules are subsystems within the integrated system. Depending upon the applications and requirements of a given customer, the integrated system can be customized to include only the desired subsystems. As such, FIG. 1 is but one example of a system within the scope of the invention.

System 100 may be configured in a variety of ways depending on the needs and applications of the user. In some embodiments, system 100 may be configured as a full kiosk, in which most if not all components of the system are fully enclosed. In such embodiments, all components may be fully automated and an untrained user may be capable of operating the entire system. An added advantage is that the untrained user faces no risk of injury from heat, clamping, pinching, or moving parts since the kiosk is fully enclosed.

In other embodiments, system 100 may be configured as a clerk-operated kiosk with an offboard inventory of products to be sublimated. In this configuration, a subset of the automated modules discussed above may be substituted with manual variations operable by an operator such as a clerk or employee of a retail establishment. A clerk-operated kiosk may be situated in a retail establishment in a location accessible to employees of the establishment, such as behind a counter or in a restricted area. In the clerk-operated kiosk configuration, system 100 may or may not have all components enclosed.

In still other embodiments, system 100 may be configured as a customer-operated kiosk with an offboard inventory of products to be sublimated. In this configuration, a subset of the automated modules discussed above may be substituted with manual variations operable by an untrained operator such as a customer of a retail establishment. A customer-operated kiosk with an offboard inventory of products to be sublimated may be situated in a retail establishment in a location potentially accessible both to customers of the establishment and to employees of the establishment. In the customer-operated kiosk configuration, system 100 may or may not have all components enclosed. The non-enclosed components may not be fully accessible to the customer. In some embodiments, system 100 may be configured as a hybrid kiosk with offboard inventory, with some modules configured to be operable by a clerk, and some configured to be operable by a customer.

System 100 includes a printer 2 for printing images onto transfer media. Printer 2 may be electronically configured to receive a digital image file from an operator or a customer. The digital image file may represent images such as pictures, text, stylized text, or a combination of these elements. In some embodiments, printer 2 may receive the digital image file directly, and may include digital media input interface components. In other embodiments, printer 2 may be linked via a physical or a network connection to a distinct interface device or module (not shown) which is configured to receive the digital image file and/or permit a user to determine a digital image file for printing. System 100 and printer 2 may be configured to receive a digital image file from a user in various ways, including but not limited to receiving insertion of flash memory or a USB drive, connecting via a USB or Firewire® cable, receiving image files by email, receiving image files uploaded via a mobile application, retrieving user-submitted image files from an online library or website, etc. In some embodiments, system 100 may include a scanner, which can receive a physical image from a user, convert it into a digital image file, and provide it to printer 2. The scanner may be further configured to enhance or alter the acquired digital image file before providing it to printer 2. Examples of image file enhancements may include, but are not limited to, changing the size of the image, rotating, reversing, or translating the image, altering color brightness, reducing blur, de-skewing, etc.

In other embodiments, printer 2 may be configured to receive a digital image file selected at the point of sale by a user from a library or database containing a plurality of preloaded stock image files. In still other embodiments, printer 2 may be configured to receive a digital image file taken by a camera, which may be (but need not necessarily be) associated with system 100. In yet other embodiments, system 100 may be capable of receiving input in the form of text from a user, and may convert or incorporate the text into a printable digital image file for sublimation. Printer 2 and/or the interface device may be configured with software components that enable analysis, processing, and editing of the received or selected digital image files. In some embodiments, the configured software components may be capable of determining image characteristics, including but not limited to image size, the color composition of the image, the pixel intensities of the pixels comprising the image, the density of the pixels in the image as a whole or in specific regions of the image, the color palette range, etc.

Printer 2 may be configured to utilize standard sublimation dyes known in the art to print the received digital image file onto suitable transfer media. The transfer media may comprise any material capable of receiving a printed dye image, including but not limited to coated or uncoated paper, card stock, film, resin, wax, ribbon, tape, etc.

In the illustration shown in FIGS. 1 and 2, printer 2 is configured to print images onto individual sheets of transfer media. In some embodiments, printer 2 may include or be connected to a bulk storage unit containing a plurality of sheets of transfer media. In other embodiments, individual sheets of the transfer media may be fed into printer 2 one sheet at a time. Printer 2 may be configured to automatically feed the sheets of transfer media into proximity with the print end effector and sublimation dyes for printing. Alternatively, printer 2 may be configured as a manual, hand-fed printer in which an operator may introduce each sheet of transfer media into the printer. Some embodiments of printer 2 may be capable of both manual and automatic sheet feeding. In alternative embodiments, the transfer media may be provided on continuous rolls of media rather than individual sheets, which will be described in further detail in association with FIGS. 3 and 4.

Printer 2 may be configured to print a dye image on one side of each sheet of the transfer media, or alternatively may be capable of printing dye images on both sides of each sheet. Printer 2 may be configured to print the images in a single pass, or may require two passes, such as for complex images, multiple colors, or multiple layers of images. For example, a printed dye image may include multiple distinct images superimposed into a single image. Printer 2 may print the superimposed image in a single pass, or may print each constituent image in its own pass through the machine.

In some embodiments, the sheets of transfer media supplied to printer 2 may be configured to facilitate transfer of a printed image onto multiple surfaces of a product. The sheets of transfer media may contain pre-treatments or features that bisect the sheets and enhance the reliability and repeatability of folding. In some embodiments, the sheets may be pre-creased. In other embodiments, the sheets may be pre-scored. In yet other embodiments, the sheets may be perforated. In alternative embodiments, the bisecting feature may comprise a line pre-printed onto the transfer media that is configured to align with other components of the system, such as a mechanical element associated with end effector 8 or a fold bar (not shown). System 100 may employ mechanical or optical non-contact sensing elements to assist with alignment of the pre-printed line. In these embodiments, printer 2 may print one or more images on either side of the bisecting feature of the sheet to correspond to images that will be sublimated onto various surfaces of a product. The pre-creasing, pre-scoring, pre-printing of a line, and/or perforation of the sheets readily enables proper alignment of the printed images with respect to each other, with respect to system 100, and with respect to the products to be sublimated. In some embodiments, the bisecting feature may serve as a positional register for the system, since its location is predictable on the sheets of transfer media. The pre-creasing, pre-scoring, pre-printing of a line, and/or perforation of the sheets of transfer media further facilitates sublimation of images onto opposing sides of a product. System 100 may include components that are configured to manipulate the transfer media at the bisecting feature (e.g. crease, score, line, or perforation), in a manner that substantially surrounds both sides of a product. In such embodiments, both sides can be sublimated substantially simultaneously with increased efficiency and reduced time, wear on the machine, and waste.

Printer 2 may provide printed sheets of transfer media to other components of system 100 in various ways. In the illustrated embodiment shown in FIGS. 1 and 2, printer 2 is disposed at an angle such that gravity assists the providing of the printed sheets. When printing is complete, the sheet may naturally fall onto transfer media tray 4 and interact with other components of system 100. In other embodiments, components may assist the printed sheets of transfer media to interact with other components. For example, printer 2 and transfer media tray 4 may interface with a feed line comprising a series of guides and rollers that may lead the sheet to the next component of the system. In alternative embodiments, particularly clerk-operated kiosk embodiments with offboard inventory, system 100 may be configured to simply allow an operator to place and transport the printed transfer media by hand to other parts of the system. In these embodiments, printer 2 may be disposed in a manner such that it is separate from the rest of the components of system 100 and not enclosed in any kiosk or housing associated with the system. For example, printer 2 and tray 4 may not be physically connected to one another. In these embodiments, an operator may feed the sheet or sheets of transfer media into printer 2 for printing, and then manually place the transfer media, now containing the printed images, onto tray 4 for introduction into the other components of system 100. In still other embodiments, system 100 may include an active transport mechanism, such as transport mechanism 6, to assist with positioning of the transfer media. In still other embodiments, a user may place the transfer media with a printed image directly onto a substrate within the housing, such as substrate 10.

Transport mechanism 6 may be any type of robot configured to transfer elements through system 100. In the illustrated example of FIGS. 1 and 2, transport mechanism 6 is configured as a linear robotic unit disposed on rails, with a control end effector capable of coordinating linear movement in three dimensions. In other embodiments, transport mechanism 6 may be a true mechanical arm capable of free range motion in all directions. Transport mechanism 6 may include a stepper motor, a piezoelectric motor, or any other system of mechanized propulsion. In some embodiments, transport mechanism 6 may be battery-powered and be independent from any electrical system associated with system 100.

Transport mechanism 6 (including end effector 8) may be configured to interface with the transfer media and/or products for sublimation. End effector 8 may include members that allow it to physically grasp items, such as pillars, pegs, or claws. End effector 8 may include magnets that allow it to transport and manipulate magnetic metallic items via electromagnetic force. In other embodiments, end effector 8 may be connected to a vacuum system and may be configured to pick up and transport items via suction. In some embodiments, end effector 8 may be configured to pick up and transport items via the mechanical grasping members described above. In some embodiments, transport mechanism 6 may contain multiple end effectors 8.

Transport mechanism 6 and end effector 8 may thus be configured to transport printed sheets of transfer media to other parts of system 100. In some embodiments, mechanism 6 moves the transfer media directly from tray 4 to substrate 10. As discussed above, the printed transfer media may access tray 4 directly from printer 2, and may automatically be fed onto the tray. In other embodiments, the printed transfer media may be placed directly on tray 4 by an operator or by transport mechanism 6. Substrate 10 is a flat platen configured to receive the transfer media and align and register it to prepare for the sublimation process. In some embodiments, substrate 10 may be a bare platen comprised of metal, plastic, or composite product. In preferred embodiments, substrate 10 may be coated or covered with a thermally insulating material, such as a thermal neoprene or a foam rubber, to minimize unwanted heat transfer and loss during the sublimation process. In alternative embodiments, substrate 10 may be configured to provide heat to the sublimation process.

Substrate 10 may include components that assist in positioning and securing the transfer media to ensure faithful transfer of the printed image to a desired product. In some embodiments, particularly the clerk-operated kiosk embodiments discussed above, an operator may place the printed transfer media directly onto substrate 10, and transport mechanism 6 may assist only in registration and alignment of the printed transfer media. In some embodiments, substrate 10 may be disposed above a vacuum system (not shown) which provides light suction to secure a portion of the printed transfer media onto substrate 10. In other embodiments, substrate 10 may include one or more clamps disposed on top of the substrate to secure the transfer media to the substrate for sublimation.

Transport mechanism 6 and/or substrate 10 may include features, such as contact or non-contact sensors, to assist with the registration and alignment of the transfer media and/or the products that will receive the sublimated image. Further detail of exemplary mechanical and non-contact sensors is described below and illustrated in FIG. 11.

In some embodiments, system 100 may include a product staging position 12. Product staging position 12 may constitute a platform, basin, magazine, or any structure/area that can receive and provide one or more products or accessories to be sublimated. When present, product staging position 12 may be a constituent part of system 100, it may be adjacent to the system, or it may be proximal to system 100 but not in contact with its components. In some embodiments, staging position 12 is accessible by transport mechanism 6.

In some embodiments, staging position 12 may be pre-configured to substantially match the dimensions of a selected product. For example, in some embodiments staging position 12 may include one or more dedicated areas or regions sized and shaped to readily fit one of each of a plurality of products available to the system for sublimation. In other embodiments, staging position 12 may include a single area tailored to fit a single type of product. In still other embodiments, staging position 12 may include an area tailored to universally fit any product available to the system for sublimation. Staging position 12 may be configured to receive products in an automated manner from other components of system 100, or alternatively may be configured to receive products manually placed by a user (e.g. a store employee or a customer).

As part of the sublimation process, one or more selected products for sublimation may be placed on staging position 12 for introduction into system 100. The products may be situated on staging position 12 permanently, or may be placed there either manually or automatically for purposes of a sublimation task. Controlled orientation of the product to be sublimated is important for completion of a high-quality sublimation task. To that end, products for sublimation may comprise packaging or other external features that permit proper localization and registration of the products within the system at all times. The products, whether packaged or unpackaged, may nest within one another or within the defined tailored areas of staging position 12. Products for sublimation may be comprised of various materials. In some embodiments, the products may be comprised of plastic. In other embodiments, the products may be comprised of metal, such as aluminum, brass, or steel. In alternative embodiments, the products may be comprised of a ceramic material, a fabric or textile material, wood, fiberglass, or glass. In some embodiments, the product, regardless of its constituent material, may be additionally coated with a material to enhance integration and permanence of the sublimation dye, such as a polyester material. The added coating may be introduced to the surface of the product in various ways, such as spraying, dipping, painting, etc.

System 100 may be configured to detect the material or materials comprising the product. In some embodiments, staging position 12 may be configured to recognize that a selected product from a plurality of products has been placed on the staging position. For example, as discussed above, staging position 12 may include one or more dedicated areas or regions sized and shaped to readily fit one of each of a plurality of products, and may be configured to detect when a selected product is occupying the area or region dedicated to fit a product of that type. Staging position 12 may be configured to transmit information relating to a product and its properties to other components of system 100.

In other embodiments, substrate 10 may be configured to detect or determine properties of the product such as its material composition. In some embodiments, substrate 10 may include a machine vision system, as discussed above, and may be configured to capture an image of the selected product once it has been transported to substrate 10 by transport mechanism 6. System 100 may be configured with software and hardware components to detect a product based on the captured machine vision image and associate it with information relating to material composition for the detected product. The associated information may be stored locally in memory devices associated with system 100, or it may be stored on a remote server and accessed by system 100 using network architecture components.

Substrate 10 and/or staging position 12 may additionally be configured to automatically detect the identity, material composition, and other properties of a product based on indicia printed on the product itself or on materials accompanying the product, such as individually wrapped packaging. The indicia may constitute machine-readable barcodes, printed patterns, QR codes, etc. In some embodiments, the indicia may be directly read by an optical scanner associated with substrate 10 and/or staging position 12, such as a machine vision system of substrate 10. In other embodiments, the indicia may be captured by a camera and analyzed and confirmed via software.

System 100 may additionally be capable of identifying a product and its constituent properties via the optionally installed interface device. The interface device, which will be described in further detail below, may receive a selection of one product from a plurality of available products for sublimation. The selection may designate a standard product previously known to system 100 (e.g., it is a specific product or type of product that has been sublimated by system 100 previously, or it is a product specifically configured to be sublimated in system 100), or it may designate a new, user-provided product. In such embodiments, system 100 may prompt the user for additional information, such as a generalized category of item or a generalized question about its material composition. For example, the interface device may ask the user "WHAT TYPE OF ITEM IS THIS?" and present choices for selection and confirmation, such as "DOG TAG," "KEY CHAIN," "LUGGAGE TAG," etc. A further question might be presented to the user, such as "WHAT IS THIS ITEM MADE OF?" and present choices for selection and confirmation such as "METAL," "PLASTIC," "CERAMIC," etc. System 100 may then compare the received information about the user's product to a specific product or type of product that has been sublimated by system 100 previously, or to a product specifically configured to be sublimated in system 100 for which properties are already known. It is understood that the presented configurations of the interface device here are intended to be exemplary only, and that any manner of determining more information about a product or its properties is within the scope of the invention.

Possible candidate products and accessories for use in system 100 may include, but are not limited to, luggage tags, pet tags, bookmarks, identification tags, dog tags, gift tags, ornaments, picture frames, picture frame inserts, cases for a mobile device, inserts for cases for a mobile device, various types of jewelry, such as pendants, bracelets, watch bands, earrings, necklaces, etc., fabrics, such as clothing, banners, draperies, etc., and any item that could integrate sublimation dye and bear a sublimated image. In some embodiments, products for sublimation in system 100 are flat plates with opposing surfaces. In some embodiments, the products for sublimation may include keys, key end effectors, or key blades. In other embodiments, products could be flat, three-dimensional shapes, such as cubes. In still other embodiments, curved surfaces are possible. In these embodiments, products such as coffee mugs, decorative glass products such as vases or barware, sports balls, and medical identification bracelets could be candidates for receiving sublimated images. Candidate products for sublimation may be provided by the user, or they may be disposed within or proximal to the printing system. In some embodiments, described in further detail below, the system may be configured as a vending system and the products may be situated inside of the system. In some configurations, the vending system may be capable of receiving a product inserted into the machine by a user. The system may be further configured to receive, sublimate, and/or dispense accessory items that match or accompany candidate products for sublimation. The accessories, in a similar manner to the products, may be contained within the system, proximal to the system, or may be inserted into the system by a user. Examples may include, but not be limited to, picture frames, luggage tag holders, bracelets, jewelry, key chains, necklaces, key rings, etc. In some embodiments, the inserted accessory may be a pre-packaged accessory designed to accompany the customized sublimated product.

As described, transport mechanism 6 may transport a selected product from staging position 12 to substrate 10. Mechanism 6, via end effector 8, may grasp the product with included mechanical features, such as claws, hooks, etc. For metallic products, end effector 8 may engage the product with magnets. In other embodiments, end effector 8 may use vacuum suction to pick up the product and hold it while transport mechanism 6 translates end effector 8 to substrate 10. Transport mechanism 6 may be configured to place the product to be sublimated onto a sheet of transfer media pre-aligned onto substrate 10. In alternative embodiments, transport 6 may be configured to place the product directly onto substrate 10 and place the transfer media on top of the product. Transport mechanism 6 may be configured to place the product directly onto one or more of the printed images printed onto the transfer media, and may be assisted in the process by one or more of the mechanical guides, mechanical switches, optical switches, machine vision systems, or cameras associated with substrate 10 described previously. In some embodiments, transport mechanism 6 may be further configured to manipulate the transfer media to substantially surround the product once it is oriented on substrate 10, with one or more printed images thereby positioned onto each side of the product to be sublimated. The manipulation may constitute folding the transfer media at its bisecting feature, and transport mechanism 6 may execute the folding process using mechanical implements associated with end effector 8.

System 100 may sublimate the printed images on the transfer media to selected products using heating platen 14. System 100 may contain one or more heating platens. In the embodiment illustrated in FIGS. 1 and 2, system 100 contains a single heating platen. However, in alternative embodiments, more than one heating platen may be employed in system 100, and substrate 10 may constitute a second heating platen. In alternative embodiments, multiple heating platens may be placed in series, with non-heated platens such as substrate 10 opposing each heated platen. Heating platen 14 may be comprised of any heat-conductive material, such as metal or ceramic. In some embodiments, heating platen 14 is comprised of cast iron, aluminum, or zinc.

Platen 14 may additionally be coated with a compliant material. Such a coating may comprise a foam, rubber, or plastic possessing the ability to maintain structural integrity under high temperatures and pressures. The compliant nature of the platen coating assists in the application of an even heat and pressure across all surfaces to be sublimated. Maintaining consistency of heat and pressure results in higher quality sublimated products, and reduces the risk of damage to either the product or the platen. In some embodiments, substrate 10 may be similarly coated with such a compliant material. In some alternative embodiments, heating platen 14 itself may have inherent flexibility, and may be capable of deformation across a product during sublimation to ensure even application of heat and pressure.

System 100 is configured to move heating platen 14 into contact with the transfer media as situated on substrate 10. Heating platen 14 may be configured as a pivoting assembly, such as that illustrated in the example of FIGS. 1 and 2. In such a configuration, heating platen 14 may pivot through an angular range of motion around a pin, bolt, or other fulcrum to contact the transfer media. In some embodiments, the pivoting mechanism may be machine-assisted. For example, heating platen 14 may include a hydraulic system, electrical actuator, pneumatic system, or combination thereof to control the rate of pivot of heating platen 14, and also assist with automation of the heating process. Such a system is optional, and is illustrated in the examples of FIGS. 1 and 2 as hydraulic system 16.

Heating platen 14 is operated by system 100 in a single thermal cycle to sublimate the printed images from the transfer media onto the product. The single thermal cycle of heating platen 14 may be configured with a temperature, pressure, and duration sufficient to successfully transfer the image(s) to the selected product. The duration of the thermal cycle, measured as the dwell time of the platen on the transfer media, may vary based on the product to be sublimated, the transfer media, and the heating temperature of heating platen 14. In some embodiments, heating platen 14 is maintained at a temperature of about 400 degrees Fahrenheit for the entirety of the time that it is in contact with the transfer media. The pressure governing the single thermal cycle may be a defined, measured physical force.

In some embodiments, the linear distance traveled by heating platen 14 may be monitored and programmed as part of the single thermal cycle in lieu of or in addition to the pressure. In some embodiments, system 100 may include a control unit for controlling the linear distance traveled by the one or more heating platens. Controlling the linear distance may be important for avoiding breakage of a sublimated product and/or damage to the heating platen or substrate. Such a measurement could be particularly useful in the sublimation of fragile, three-dimensional objects such as ornaments or jewelry. Linear distance may be measured in some embodiments as the distance between heating platen 14 and substrate 10. This linear distance may be preset for particular products based on their known dimensions. In such an embodiment, the movable heating platen, such as heating platen 14, may be pre-configured (e.g. through software executed by the control unit) to have a "hard stop" that achieves a desired linear distance from the substrate 10. In some embodiments, the temperature, pressure, and duration of the cycle are governed by the control unit (not shown) and software that automatically configures these parameters for the heating platen for a particular sublimation task. In some embodiments, the control unit is disposed within a user interface device (not shown) which is configured to determine the parameters.

The temperature, duration, and pressure of a heating platen 14 single thermal cycle may be determined based on a variety of predetermined criteria. In some embodiments, the predetermined criteria may include properties of the product being sublimated, including but not limited to dimensions of the product, the material comprising the product, the product's shape or curvature, etc. In some embodiments, the predetermined criteria may be received or automatically determined by components of system 100 as described above. In some embodiments, the predetermined criteria may include characteristics of the printed images, including but not limited to pixel intensity or density of the printed image, colors utilized in the image, size of the image, etc. In these embodiments, the characteristics may include those determined for the selected image by printer 2 and/or the optional interface device at the time of printing onto the transfer media, as described above. In some embodiments, heating platen 14 may be configured to provide differential heating based on the predetermined criteria; for example, one or more regions on heating platen 14 may be heated to a different temperature than one or more other regions on the platen. In other embodiments, the differential heating may comprise one or more regions on heating platen 14 that transmit heat for a different duration of time than one or more other regions on the platen. Different pressures may also be utilized. Pressure as used herein may refer to a programmed force configured by the control and exerted as a pressing force by heating platen 14, or it may relate to a position in three dimensional space achieved by heating platen 14 during the thermal cycle (e.g., rotation of a greater number of degrees by a pivoting platen assembly would indicate more pressure being exerted, or greater travel in the Y-dimension).

The single thermal cycle of heating 14 may be further governed by external factors, such as conditions within the establishment hosting system 100. As discussed above, it is ideal that system 100 be capable of operating within a conventional electrical power configuration, utilizing either a standard 120 volt plug or a dedicated 240 volt plug, such as that used in larger household appliances. System 100 must be capable of heating relatively quickly without exceeding or draining the power capacity of its host establishment. Therefore, in some embodiments where available power is limited, system 100 and heating platen 14 may be configured in the control software with alternate automated warm-up and cool-down cycles to permit successful sublimation within an existing electrical configuration. In these embodiments, the system may be flexibly reconfigured via the control software to integrate into various deployment environments without the need to replace, alter, or custom design hardware components.

System 100 may include a control unit to regulate the temperature of heating platen 14. In some embodiments, the control unit may be configured using software to automatically de-energize the heating platen in the event of heating platen failure or overheating over a threshold temperature. In these embodiments, the system may further include a redundant secondary safety system independent of heating platen 14 and the control unit to de-energize the heating platen should both the heating platen and the control unit malfunction. The control unit may be the same control unit described previously that regulates the linear travel of heating platen 14, or it may be a separate control unit. In some embodiments, heating platen 14 may be consistently kept at its operating temperature. In other embodiments, heating platen 14 may be turned off and cooled down between each sublimation task. This configuration may be motivated by safety concerns or for energy efficiency. As an alternative, heating platen 14 may be configured to remain at an intermediate steady state temperature. In this embodiment, heating platen 14 may be configured to quickly increase its surface temperature from the steady state point to a sublimation temperature. Maintaining heating platen 14 at a temperature intermediate of ambient temperature (e.g. 200 degrees Fahrenheit) and sublimation temperatures (e.g. 350 degrees Fahrenheit) allows for quick ramping up to a sublimation temperature. Such a configuration may reduce the wait time to complete a sublimation task, which would lead to more profit-generating capability and more satisfied customers. The intermediate temperature should be selected such that the electronic and/or mechanical components of system 100 internal to the housing are not adversely affected. To facilitate the variability of heating platen 14 temperatures, the control for heating platen 14 disclosed above may be configured to execute warm-up and cool-down cycles for the platen as needed.

In some embodiments, the control unit for heating platen 14 and/or user interface device associated with system 100 may include a timer that governs the platen warm-up and cool-down cycles on a set schedule based on certain criteria. In some embodiments, the warm-up and cool-down cycles may be configured based on time of day or day of the week, to account for store traffic. For example, heating platen 14 may be kept at a higher steady state intermediate temperature (thus leading to a shorter warm-up cycle) on a Saturday afternoon versus a Tuesday morning because more traffic is likely in the host establishment on Saturdays. In other embodiments, the timer may monitor the time since the last sublimation task was completed, and may gradually cool down the platen accordingly. This functionality could be used to automatically shut down the heating platen at the closing time of the host establishment; the timer could be configured to shut the heating platen off completely after a certain number of hours have passed since the last sublimation job. Such a configuration promotes safety and energy efficiency without requiring constant supervision and monitoring of the platen temperature.

In some embodiments, the control unit for heating platen 14 may alter the thermal cycle for the sublimation based on whether the sublimation task is single-sided or double-sided. The control unit may alter one or both of the heating platen temperature and the duration of the contact between the heating platen and the transfer media. Although the range of sublimation temperatures may be relatively narrow, for energy efficiency purposes a slightly lower temperature may be utilized in a single-sided sublimation versus a double-sided, since there is no need for heat to penetrate through the thickness of the product. For products comprised of certain materials, the duration of the thermal cycle may be lengthened for double-sided sublimation due to thermal resistance within the material. For example, a material with low thermal resistance such as aluminum may have similar or identical thermal cycle durations for single versus double-sided sublimation; for example, in the range of fifty seconds in both cases. Materials with slightly higher thermal resistance, such as brass, may take slightly longer for double-sided sublimation. For example, double-sided brass sublimation may take sixty to seventy seconds versus fifty seconds for single-sided printing. On the extreme end of the equation is a material with high thermal resistance, such as some ceramic materials. Double-sided sublimation of these materials may require durations on the order of minutes rather than seconds.

In alternative embodiments, heating platen 14 may be configured as a linear travel assembly rather than a pivoting assembly. Heating platen 14 may thus be disposed on one or more vertical rails, and its motion may be restricted to a single vertical direction. Such a configuration will be described below in association with FIGS. 3 and 4.

Heating platen 14 is configured to execute the single thermal cycle in a manner that sublimates printed images onto all desired sides of the selected product substantially simultaneously. Such a configuration streamlines and expedites the sublimation process, and provides the capability to provide a wide range of customized and personalized sublimation products. Advantages to printing opposing sides of a product simultaneously include increased efficiency, reliability, and repeatability of the process. Wear on the system is essentially halved, and thus the life of the machine should be increased and maintenance costs and down time should be reduced. The reduced time taken to sublimate a product for a customer enhances the attractiveness of the product offering in a retail environment; a customer is more likely to purchase a product if the product can be sublimated quickly. Moreover, quicker production time increases the revenue-generating capability of the machine, as less time per sublimation job means more jobs can be completed during operation hours. Sublimating both sides in a single thermal cycle is also an advantage because it increases the consistency of the transfer process. Again, reducing the number of processes and the complexity of such processes will extend the working life of a sublimation printing system.

To facilitate double-sided sublimation in a single thermal cycle, the duration of the cycle may be altered depending on the thickness of the product. As discussed above, the programmed duration must account for thermal resistance within the material comprising the product, and must ensure that all surfaces of the product are exposed to a proper sublimation temperature of, for example, approximately 350 degrees Fahrenheit without overheating, warping, or otherwise damaging the platen, the product, or the transfer media. In some embodiments, an intermediate sheet of material may be placed between heating platen 14 and the transfer media to further even out heat and pressure across the surface of the item to be sublimated. The intermediate sheet may help prevent the transfer media sticking to heating platen 14, which could smudge or blur the transferred image. The intermediate sheet may be comprised of a material capable of resisting high temperatures without losing structural integrity, such as a thermal tape, or a textile. When present, this intermediate sheet may protect both the product and the system, and increase reliability and repeatability of the sublimation process. In some embodiments, the intermediate sheet may remain associated with heating platen 14, and may not be removed after each individual sublimation task. In other embodiments, the intermediate sheet may be transported to substrate 10 and aligned and registered by transport mechanism 6 and end effector 8.

System 100 may be configured to automatically dispose of the used transfer media from substrate 10 after heating platen 14 is translated away from substrate 10. In some embodiments, transport mechanism 6 and end effector 8 may be configured to pick up, slide, or otherwise move the used transfer media off of substrate 10. In some embodiments, system 100 may include a dedicated waste collection bin to receive the used transfer media. In other embodiments, the waste may be manually collected by an operator.

In some embodiments, system 100 includes an optional cooling system, an example of which is illustrated in FIGS. 1 and 2 as cooling system 18. In some embodiments, cooling system 18 may be configured to cool the sublimated product to at least about an ambient temperature. The cooling process provides safety for handlers of the sublimated object, and also helps ensure the quality and permanence of the sublimation transfer by preventing smearing, blistering, etc. In some embodiments, cooling system 18 may constitute a heat sink. Cooling system 18 may also be configured as an active cooling system. For example, as illustrated in FIG. 2, cooling system 18 may include one or more fans in addition to a heat sink. The example of FIG. 2 illustrates cooling system 18 as a perforated metal plate with a fan disposed beneath the plate. Further detail of an exemplary cooling system is described below and illustrated in FIG. 7. In some embodiments, cooling system 18 may be configured to sense whether the sublimated product is cooled to the desired temperature. In other embodiments, cooling system 18 may be configured to allow the product to cool for a predetermined duration of time. In such configurations, cooling system 18 and/or other components of system 100 may be capable of preventing access to the product by a user or consumer until the product is sufficiently cooled. In other embodiments, cooling system 18 may include additional or alternative active cooling elements, including but not limited to a Peltier plate, a Peltier bath, spraying or immersion in liquids such as water, liquid nitrogen, etc., and a heat exchanger. In some embodiments, transport mechanism 6 may actively transport the sublimated product through a forced convection cooling field. In other embodiments, cooling system 18 may incorporate a passive method of cooling a sublimated product, such as simply allowing the product to cool over time to room temperature. In other embodiments, the passive cooling technique may cool the product via conduction, and may include placing the sublimated product in contact with a panel comprised of a material with high heat capacity and thermal conductivity, such as copper, brass, aluminum, or steel. In some embodiments, the passive cooling system may include components or elements that are capable of cooling the product through convection.

In some embodiments, system 100 may determine a custom cooling cycle for a sublimated product based on properties of the material. In these embodiments, cooling system 18 may include a control unit and a timer to regulate the cooling of sublimated products. As discussed above in relation to thermal cycle duration, products comprised of materials with high thermal resistance (such as ceramic) may require longer cooling times than products comprised of less resistant and more conductive materials, such as aluminum. The control unit of cooling system 18 may configure different durations of a cooling cycle, or in some embodiments, different methods of cooling (e.g. active cooling versus passive cooling), depending on the properties of the sublimated product. Other properties of the product that the control unit may detect and account for when determining cooling cycle parameters include the thickness of the product, the heat capacity of the material comprising the product, the thermal conductivity of the material comprising the product, and the overall mass and density of the product. Transport mechanism 6 (including end effector 8) may be configured to transport the sublimated product from substrate 10 to cooling system 18. Alternatively, substrate 10 may be capable of rotation or translation to provide the product to system 18. Further, after cooling system 18 has cooled the sublimated selected product to about an ambient temperature, transport mechanism 6 may be configured to transport the cooled sublimated product to a final location for pickup by the user. In some embodiments, confirmation of the transport may be achieved via the cameras mounted on transport mechanism 6 and/or substrate 10. Additionally, system 100 may include an optional delivery opening 20. Alternatively, cooling system 18 may be capable of rotation or translation to provide the cooled product to an included dispensing chute 20. As a non-limiting example, in FIGS. 1 and 2, the plate of cooling system 18 is mounted on a pin and is capable of pivoting, thus dropping a cooled product into delivery opening 20. As discussed above, delivery opening 20 may be configured, in concert with cooling system 18 or other components of system 100, to restrict access to the sublimated product by the user until certain conditions are satisfied. For example, delivery opening 20 may prevent access to the product until it is sufficiently cooled, until payment has been coordinated and collected, or until the user has been prompted about additional product or service opportunities.

In some embodiments, system 100 may include an associated user interface device (not shown). Some functions and configurations of the user interface device have been disclosed above, in reference to receiving and analyzing products for sublimation as well as the images to be sublimated. The user interface device may be configured to assist an operator in selecting one or more images to print on the transfer media, selecting one or more products on which to sublimate the printed images, controlling aspects of the sublimation process, and coordinating payment for the product. An exemplary user interface device will be described below in association with FIG. 8.

In some embodiments, system 100 may further include a housing (not shown in FIGS. 1 and 2), the housing configured to enclose some or all of the components of system 100 in a manner that prevents an operator from contacting the enclosed components. The housing may be comprised of metal, plastic, glass, or a combination thereof. The optional housing may serve several important functions: it protects the operator (or others) from burn, pressure, pinch, or puncture injuries that could occur as a result of contact with the system components. Further, the housing protects the system itself, shielding the components from wear and tear and keeping them clear of dust, insects/animals, etc. When equipped with an optional housing, delivery opening 20 may be configured to provide the product to an operator or another party outside of the housing.

As discussed above, when configured as a full kiosk, the housing protects the operator and other individuals who may encounter the machine. Heating platen 14 may be disposed within the housing such that it does not touch any of the housing walls, so as to maintain the external surface of the housing at a temperature safe for touch. Additionally, in some embodiments the housing may be equipped with a ventilation system. The ventilation system may result in ambient air flowing into the machine, either by natural convection or by forced convection, such as through a series of fans. In embodiments where the housing is configured to contain a ventilation system, the ventilation system may be further configured to interface with a larger ventilation system for the retail establishment or other structure hosting the system. A ventilation system may permit heating platen 14 to be kept at a steady state intermediate temperature or even at full operational temperature, without creating burn risks to users or excessively raising the ambient temperature of the surrounding air. In some embodiments, the ventilation system may be configured to control a temperature within the housing such that the mechanical and electrical components of system 100 are protected from damage and the exterior surface of the housing remains touch-safe (e.g., at a temperature that will not harm an individual when that individual's skin contacts the surface). Allowing the enclosed components, including heating platen 14, to remain at an intermediate but safe temperature reduces system warm-up time and customer wait time.

The housing also may have value-added functions for the entity hosting the system. In some embodiments, the housing may feature a decorative design that appeals to customers and attracts interest and business. The design could be proprietary to the maker of the system, or could be designed by the entity hosting the system. The housing may be configured such that a portion of the enclosure is transparent. Such a configuration provides entertainment and education to the user while the sublimation task is underway, and may also allow an operator to take note of components of the system requiring maintenance or repair. As discussed above, offboard configurations of the system may also optionally include such a housing, depending on the needs of the user.

The modular subsystem features of the system promote deployment of the system in a variety of ways. The system may be suitable for customizable footprints to meet the needs of the hosting entity. For example, if the system must fit in the corner of a room, the modular design may permit the device to wrap around the corner. A "countertop" configuration might be a good fit for a jewelry counter at a department store. The subsystem configuration increases the flexibility and versatility of the system and increases the market possibilities for the invention.

Figure 3:
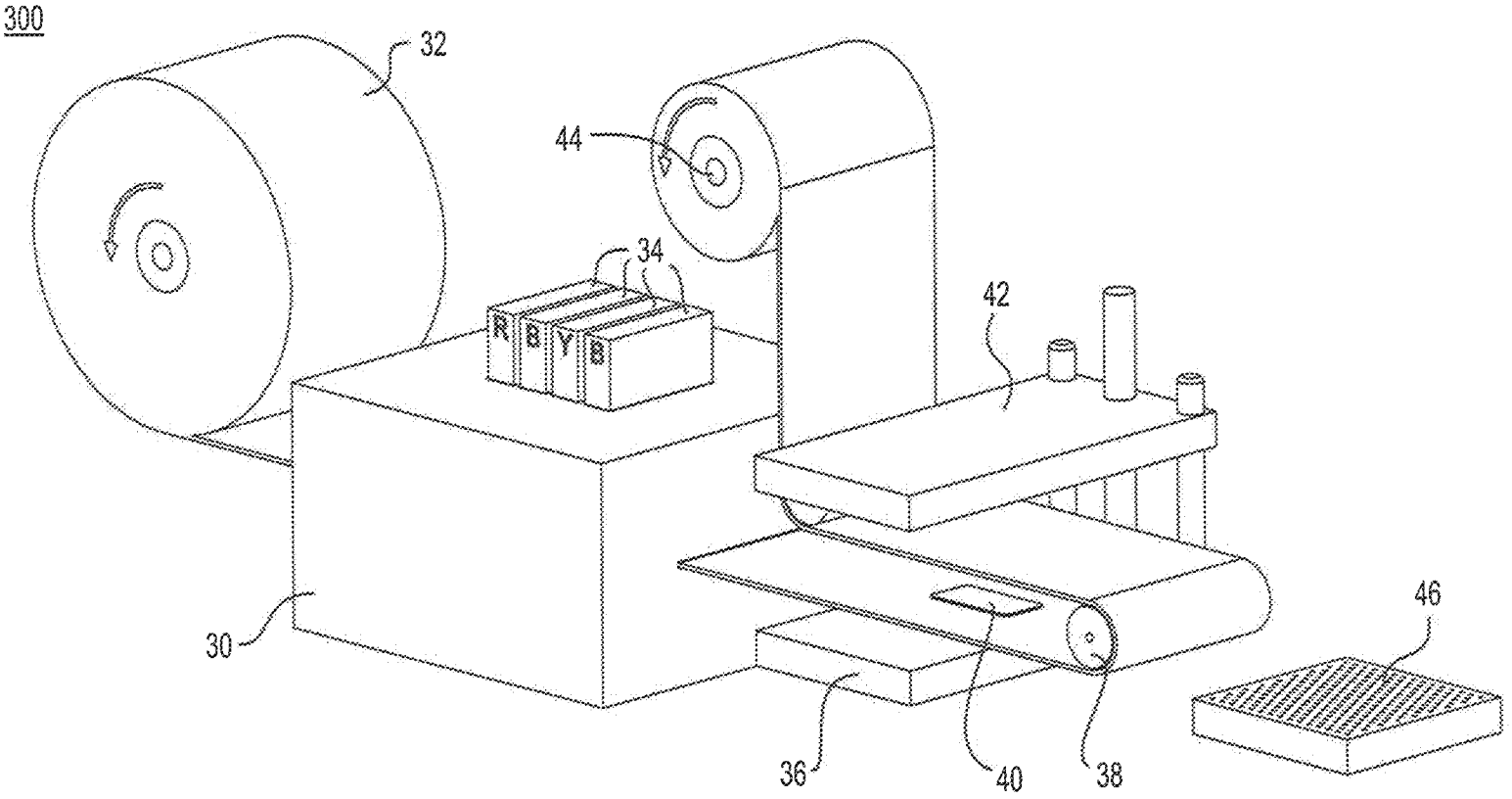
FIG. 3 is a profile view of an exemplary integrated dye sublimation printing system consistent with disclosed embodiments.
Figure 4:
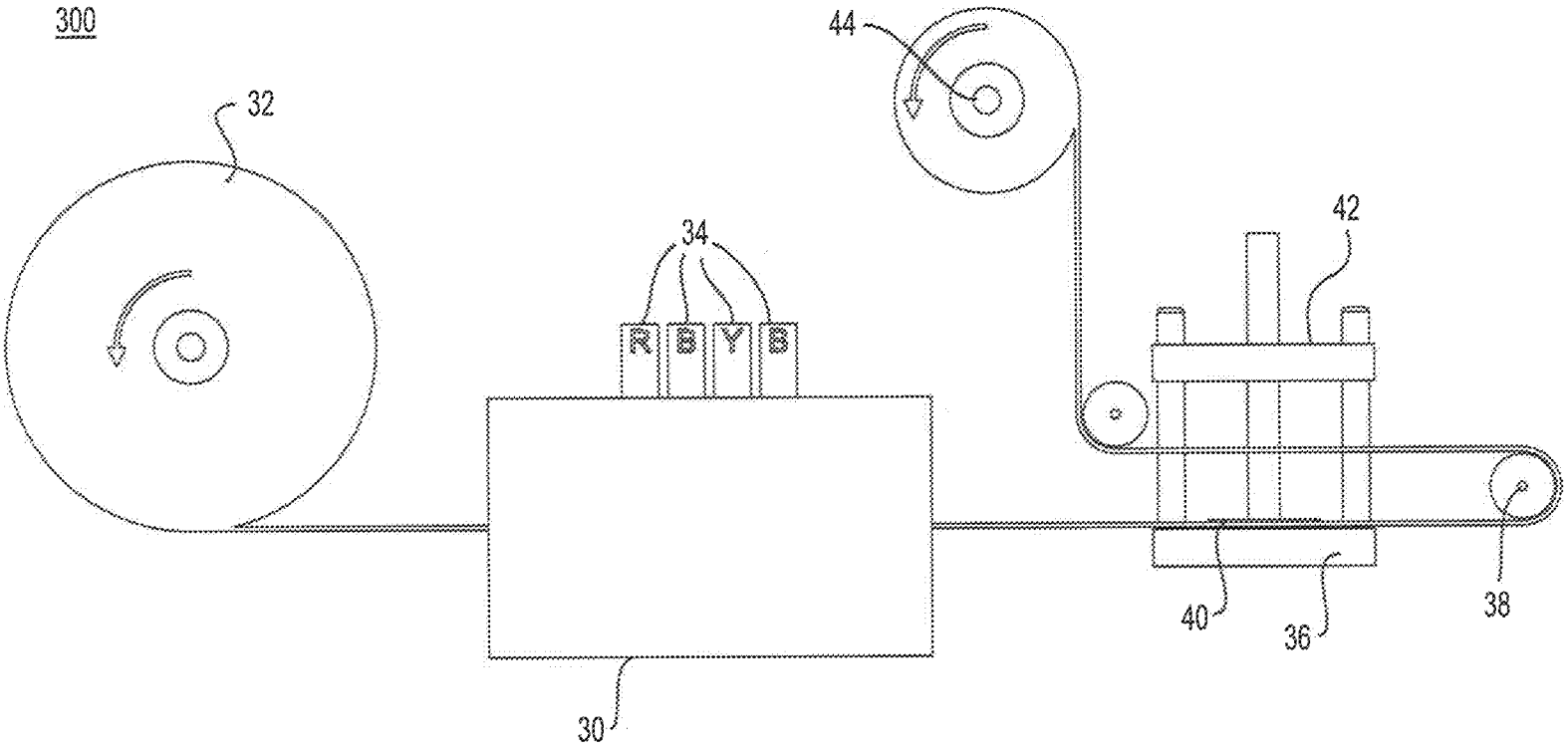
FIG. 4 is a front view of the dye sublimation transfer printing system of FIG. 3.

FIGS. 3 and 4 illustrate another exemplary dye sublimation transfer printing system 300. System 300 as illustrated is configured substantially in the same manner as system 100 described above, but with several alternative components to those described above. As the system contemplated by the invention is modular in its nature, the various components of systems 100 and 300 are not limited to those illustrated configurations, and an system constituting features from each of the illustrated embodiments in FIGS. 1-4 is within the scope of the invention.

System 300 includes a printer 30 for printing images onto transfer media. Printer 30 is substantially the same as printer 2, described above in association with FIGS. 1 and 2, with the exception that printer 30 is configured to print images onto rolls of transfer media rather than the individual sheet configuration of printer 2. Supply roll 32 provides the transfer media to printer 30. As illustrated, roll 32 may be mounted onto a spindle or pin so that it is substantially stationary, and unwinds in a counter-clockwise direction to provide a flat surface of transfer media to printer 30. In alternative embodiments, roll 32 may unwind in a clockwise direction, and one or more intermediate rollers (not shown) may be disposed between roll 32 and printer 30 for purposes of orienting and flattening the transfer media as it enters printer 30. Printer 30 may be configured to automatically feed the roll of transfer media into proximity with the print end effector and sublimation dyes for printing, which are illustrated in FIGS. 3 and 4 as print cartridges 34. Alternatively, printer 30 may be configured as a manual, hand-fed printer in which an operator may unroll a predetermined amount of transfer media and feed it manually into printer 30. Some embodiments of printer 30 may be capable of both manual and automatic sheet feeding. In some embodiments, system 300 may be configured to include more than one roll 32 and/or more than one printer 30 to optionally increase output capabilities.

Printer 30 may be configured to print a dye image on the transfer media in a configuration to permit subsequent simultaneous sublimation on multiple sides of a product. To support this capability, printer 30 may be configured with more than one print end effector and more than one set of print cartridges 34. Printer 30 may be configured to print the selected images in a single pass, or may require two passes, such as for complex images, multiple colors, or multiple layers of images. For example, a printed dye image may include multiple distinct images superimposed into a single image. Printer 30 may print the superimposed image in a single pass, or may print each constituent image in its own pass through the machine.

Printer 30 and transfer media from roll 32 may interface with a feed line comprising a series of guides and rollers that may lead the sheet to the next component of the system.

Such rollers may be manual, or may be mechanized and operated automatically by a control (not shown) system 300.

In the example illustrated in FIGS. 3 and 4, the printed transfer media is fed out of printer 30 across substrate 36, which may be configured substantially the same as substrate 10 described above. After feeding the section of the transfer media containing one or more images to be sublimated onto the top surface of a product over substrate 36, the printed transfer media is fed over roller 38 such that it doubles back on itself. In some embodiments, the position or diameter of roller 38 may be variable, to accommodate various system configurations and products of different shapes and sizes. System 300 may be configured to continue to feed the printed transfer media across substrate 36 and over roller 38 until the images to be sublimated on opposing sides of a product, such as product 40, are substantially aligned relative to one another and to product 40. In some embodiments, system 300 may include mechanical and/or non-contact sensors to assist in alignment of the transfer media, as described above in relation to system 100. Registration of the transfer media may occur by tactile or digital feedback systems. In some embodiments, the rolled transfer media may contain indicial or fiducial marks on the media that are machine-readable and indicate to system 300 when to halt feeding of the transfer media. Substrate 36 or an optional transport mechanism may be equipped with non-contact optical scanners and/or cameras (such as those described above with respect to system 100, transport mechanism 6, and substrate 10) to read the indicia on the transfer media. In alternative embodiments, the transfer media may be tractor-fed and system 300 may be configured to feed the transfer media a certain distance based on a predetermined number of perforated holes in the unprinted margins of the transfer media.

System 300 may include an active transfer mechanism (not shown), such as transport mechanism 6 and end effector 8 described above. As described, such a transport mechanism may transport a selected product from an optional staging position (not shown) to substrate 36. The transport mechanism may be configured to place product 40 onto unrolled, printed transfer media pre-placed and pre-aligned onto substrate 36. The transport mechanism may be configured to place product 40 directly onto one or more of the printed images printed onto the transfer media, and may be assisted in the process by one or more of the mechanical guides, mechanical switches, optical switches, or machine vision systems associated with substrate 36 described previously with respect to substrate 10. In other embodiments, product 40 may be manually placed by an operator onto substrate 36 in the proper position and alignment for sublimating. As discussed above, the transport mechanism may be configured to facilitate alignment and sublimation of the transfer media and the product. The transport mechanism may manipulate the transfer media to substantially surround the product, and ensure that at least one image is disposed on or near each side of the product to be sublimated.

System 300 may sublimate the printed images on the transfer media to selected products using heating platen 42. System 300 may contain one or more heating platens 42. In the embodiment illustrated in FIGS. 3 and 4, system 300 contains a single heating platen. However, in alternative embodiments, more than one heating platen may be employed in system 300, and substrate 36 may constitute a second heating platen. In alternative embodiments, multiple heating platens may be placed in series, with non-heated platens such as substrate 36 opposing each heated platen. Heating platen 42 is configured substantially the same as heating platen 14, with the exception that heating platen 42 as shown in FIGS. 3 and 4 is configured to move linearly, and is not pivotable. The linear motion of heating platen 42 may be controlled manually, or may be controlled by other means such as a stepper motor, hydraulic system, electrical actuator, pneumatic system, or combination thereof (not shown).

As discussed above in relation to heating platen 14, heating platen 42 is operated by system 300 in a single thermal cycle to sublimate the printed images from the transfer media onto the product. The single thermal cycle of heating platen 42 may be configured with a temperature, pressure, and duration sufficient to successfully transfer the image(s) to product 40. As discussed above in relation to system 100, system 300 may be configured to determine the proper temperature, pressure, and duration for the single thermal cycle based on properties of product 40 or characteristics of the received images. System 300 and its constituent components, such as printer 30, substrate 36, etc. may be configured as described above to automatically detect and analyze product properties and image characteristics. In some embodiments, the temperature, pressure, and duration of the cycle are governed by a control (not shown) and software that automatically configures these parameters for the heating platen for a particular sublimation task. In some embodiments, the control is disposed within a user interface device (not shown) which is configured to determine the parameters. Like heating platen 14, heating platen 42 may be configured to provide differential heating based on the properties of product 40 or characteristics of the printed image(s).

Heating platen 42 is configured to execute the single thermal cycle in a manner that sublimates printed images onto all desired sides of the selected product substantially simultaneously. As discussed above, such a configuration streamlines and expedites the sublimation process, and provides the capability to provide a wide range of customized and personalized sublimation products.

The used transfer media may be fed away from roller 38 and substrate 36 onto roller 44 after heating platen 42 has released contact with the media and transferred the images onto product 40. In some embodiments, the optional transport mechanism may be configured to remove product 40 from the media, or substrate 36 may be configured to pivot or translate to move product 40 off of the media. After product 40 has been removed, roller 44 may be rolled in the same direction as roll 32 to collect the used media for future disposal. Roller 44 may, in some embodiments, also be utilized to move transfer media throughout the entire system 300. Roller 44 may be configured to be rolled manually, or automatically by a control.

In some embodiments, system 300 includes an optional cooling system, illustrated in FIGS. 3 and 4 as cooling system 46. Cooling system 46 may be configured substantially the same as cooling system 18 described above. After cooling system 46 has cooled the product 40 to about an ambient temperature, an optional transport system may be configured to transport the cooled sublimated product to a final location for pickup by the user. For example, system 300 may include an optional delivery opening (not shown).

As with system 100, in some embodiments, system 300 may include an associated user interface device (not shown). The user interface device may be configured to assist an operator in selecting one or more images to print on the transfer media, selecting one or more products on which to sublimate the printed images, controlling aspects of the sublimation process, and coordinating payment for the product. In some embodiments, system 300 may further include a housing (not shown in FIGS. 3 and 4), the housing configured to enclose some or all of the components of system 300 in a manner that prevents an operator from contacting the enclosed components. When equipped with an optional housing, the optional dispensing chute may be configured to provide the product to an operator or another party outside of the housing. In the "roll" configuration illustrated in FIGS. 3 and 4, transfer media rolls 32 and 44 may also optionally be disposed outside of the housing in order to facilitate replacement by an operator. Alternatively, the housing may be accessible by the operator and the rolls may be disposed within the housing.

Figure 6:
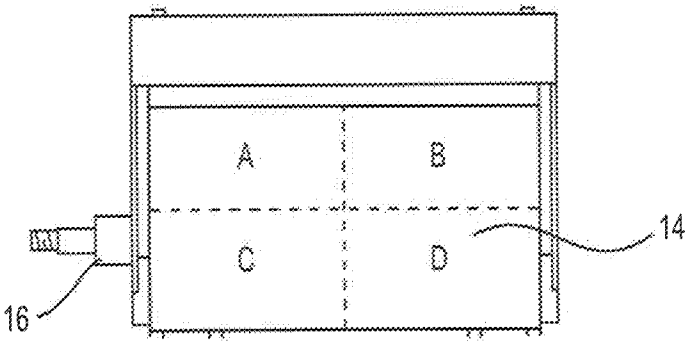
FIG. 6 is a diagrammatic illustration of an exemplary heating platen assembly consistent with disclosed embodiments.
Figure 5:
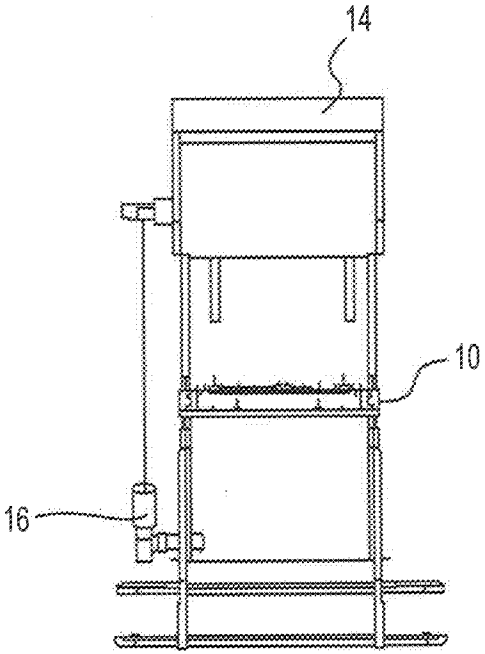
FIG. 5 is a diagrammatic illustration of an exemplary heating platen assembly consistent with disclosed embodiments.

FIGS. 5 and 6 illustrate additional views and perspectives of the single heating platen 14 described above in relation to FIGS. 1 and 2. FIG. 5 is a side view of heating platen 14 and related components. Hydraulic system 16 is illustrated in further detail, and as shown in FIG. 5 comprises a hydraulic cylinder, a linker (which may be a cam, cable, etc.), and a connector to the platen, such as a pin or bolt.

FIG. 6 illustrates how regions on the surface of heating platen 14 might be delineated for purposes of the differential heating capabilities described above. In FIG. 6, four regions A-D are illustrated on the surface of heating platen 14. Such delineation may be formal and of a structural nature, with the platen surface physically cut or segregated into the different regions. In other embodiments, the delineation of regions may be performed electronically by a control and software system, and no physical evidence of the regions may be visible on the surface of platen 14. The electronic delineation would permit rapid re-setting of region boundaries and parameters between sublimation jobs, or even within different phases of the same sublimation job. The delineation may be pre-configured in a manner such as that illustrated in FIG. 6, or alternatively heating platen 14 may be controlled to provide differential heating across one or more regions without being pre-configured. The illustration of FIG. 6 is an example configuration only and should not be taken to represent actual boundaries of any particular heating platen 14.

Figure 7:
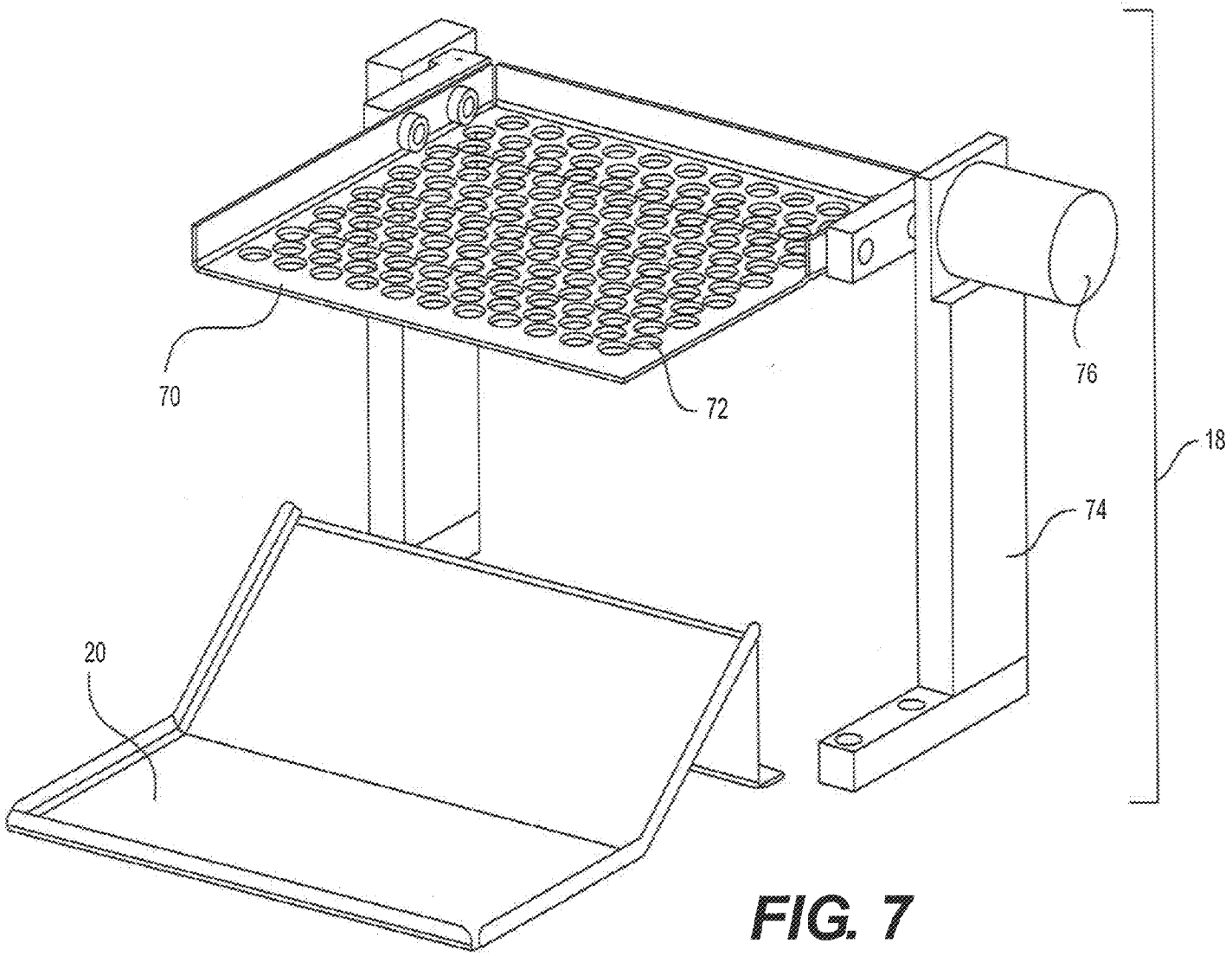
FIG. 7 is a diagrammatic illustration of an exemplary cooling and dispensing assembly consistent with disclosed embodiments.

FIG. 7 is a detailed view of one exemplary embodiment of a cooling system 18, as shown in FIGS. 1 and 2 and discussed in detail above. In some embodiments containing a cooling system, a sublimated product may be placed onto perforated plate 70. Plate 70 contains a plurality of holes 72, to permit ambient cooling or facilitate active cooling. Plate 70 may be mounted onto frame 74 and secured on one end by pin 76, on which plate 70 may be configured to pivot. In some embodiments, as discussed previously, cooling system 18 may be configured to manually or automatically drop a cooled product from cooling system 18 into delivery opening 20 by allowing plate 70 to pivot around pin 76. In some embodiments, cooling system 18 may also contain additional components to facilitate cooling, such as one or more heat sinks, fans, baths, spraying nozzles, etc. (not shown). In some embodiments, when configured as a passive cooling system, a heat sink associated with cooling system 18 may comprise a mass of a thermally conductive material with high heat capacity. In some embodiments, the thermally conductive material may be aluminum, brass, copper, or steel.

Figure 10:
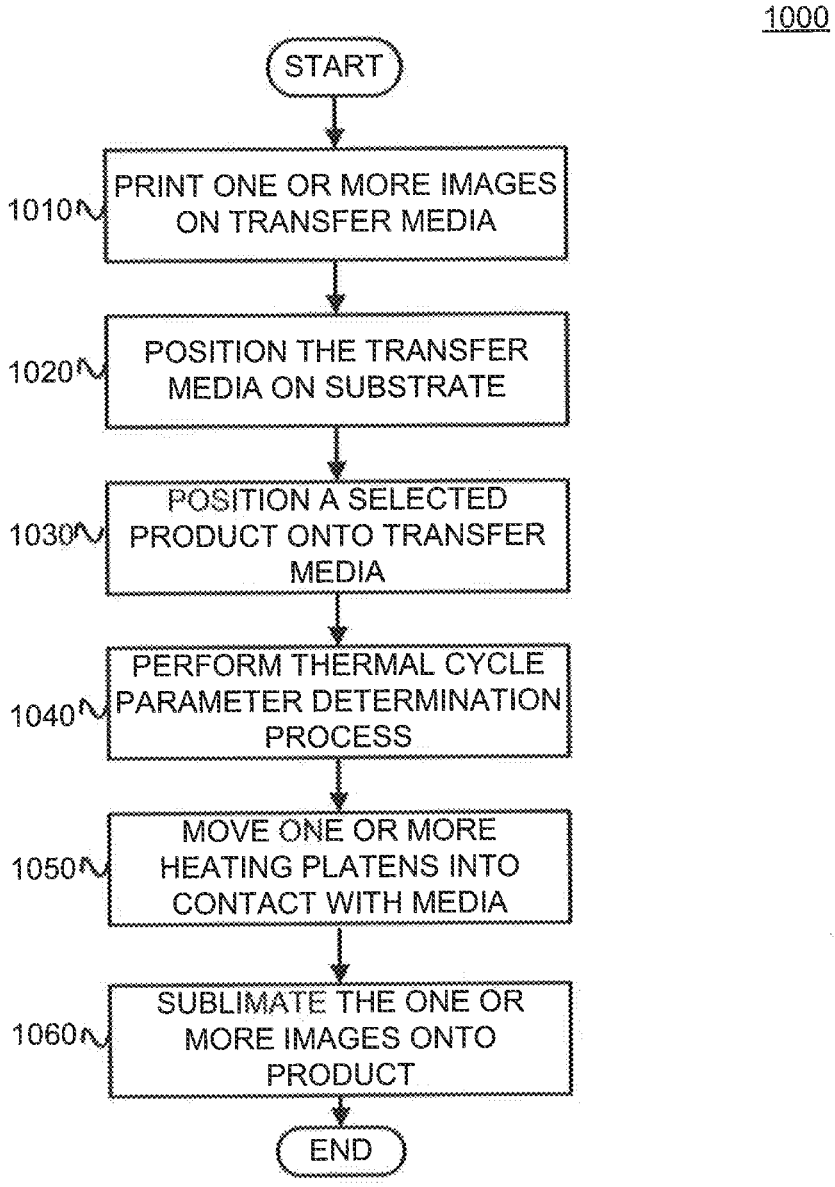
FIG. 10 is a flowchart of an exemplary dye sublimation transfer printing process, consistent with disclosed embodiments.

The systems contemplated by the invention, including the illustrated examples of FIGS. 1-7, may be configured to perform an automatic sublimated product customization process, such as that shown in the example of FIG. 10. The steps of the automatic sublimated product customization process may be performed in any order; the embodiment illustrated in FIG. 10 is intended to be exemplary only. FIG. 10 will be described in connection with dye sublimation printing system 100, but it is understood that other configurations are within the scope of the invention, such as that illustrated in FIGS. 3 and 4 as dye sublimation printing system 300. The automatic sublimated product customization process can also be configured to operate in a vending embodiment, which will be described below in association with FIGS. 8 and 12. In one embodiment, system 100 may print one or more images on a transfer media (Step 1010). The images are printed onto the transfer media by printer 2. In some embodiments, the image(s) may be a user provided image received as a digital image file through a configured user interface device. In other embodiments, the digital image file(s) may be stock image files preloaded into the memory of the user interface device. In still other embodiments, the image file(s) may constitute text input received by the user interface device. In yet other embodiments, the image file(s) may be captured by a camera associated with system 100 and the user interface device. The image file(s) may also represent a combination or composite of the above described options. As discussed above, printer 2 may also be configured to print fiducial markers onto the transfer media along with the images. The user interface device may determine the dimensions of the product to be sublimated during the image printing process, and may control printer 2 to print fiducial markers in a particular place on the transfer media based on product dimensions.

System 100 may position the transfer media onto a substrate, such as substrate 10 (Step 1020). As discussed above, in some embodiments, the transfer media may comprise sheets of transfer media that are deposited onto tray 4 after being printed by printer 2. In some embodiments, an optional transport mechanism, such as transport mechanism 6, may move the printed sheet of transfer media from tray 4 to substrate 10. As discussed, in alternative embodiments, system 100 may be configured to move the transfer media to substrate 10 in a variety of ways. Once placed in proximity to substrate 10, system 100 may position and align the transfer media on the substrate using one or more of the components described above, such as the fiducial markers, mechanical guides, mechanical switches, optical switches, machine vision tracking systems, or a combination of one or more such components. Additional detail on the alignment process will be discussed below in association with FIGS. 13 and 14.

System 100 may position a selected product onto the transfer media (Step 1030). In some embodiments, the selected product is placed automatically by system 100 onto staging position 12, and then transport mechanism 6 (via end effector 8) transports the product from staging position 12 to substrate 10. In other embodiments, either the placement of the product on position 12 may be manual, the transport of the product to substrate 10 may be manual, or both. Alignment of the product on the transfer media may also utilize one or more of the fiducial markers, mechanical guides, mechanical switches, optical switches, and machine vision tracking systems described above. The product may be aligned onto one of the printed images on the transfer media. In some embodiments the alignment may be assisted by recognition of fiducial markers by the machine vision tracking system. In some embodiments, the optional transport mechanism, such as transport mechanism 6, may further be configured to manipulate the transfer media to substantially surround the product, wherein at least one printed image is positioned on each side of the product.

System 100 may be configured to perform a thermal cycle parameter determination process, to determine parameters of the single thermal cycle such as temperature, duration, and/or pressure. An exemplary thermal cycle parameter determination process will be discussed below in association with FIG. 11. In brief, components of system 100, including the interface device and other computing components, may detect the product to be sublimated and determine properties of said product. System 100 may further analyze characteristics of the images printed on the transfer media by printer 2. In some embodiments, system 100 may automatically determine based on the printed images whether the sublimation task is single or double-sided. Finally, system 100 may determine both thermal and cooling cycle parameters for the thermal cycle based on the properties of the product and/or the characteristics of the image, and configure the heating platen to perform the determined thermal cycle.

Process 1000 continues with system 100 moving one or more heating platens, such as heating platen 14, into contact with the transfer media (Step 1050) and sublimating the one or more printed images onto the product based on the determined single thermal cycle (Step 1060).

Figure 11:
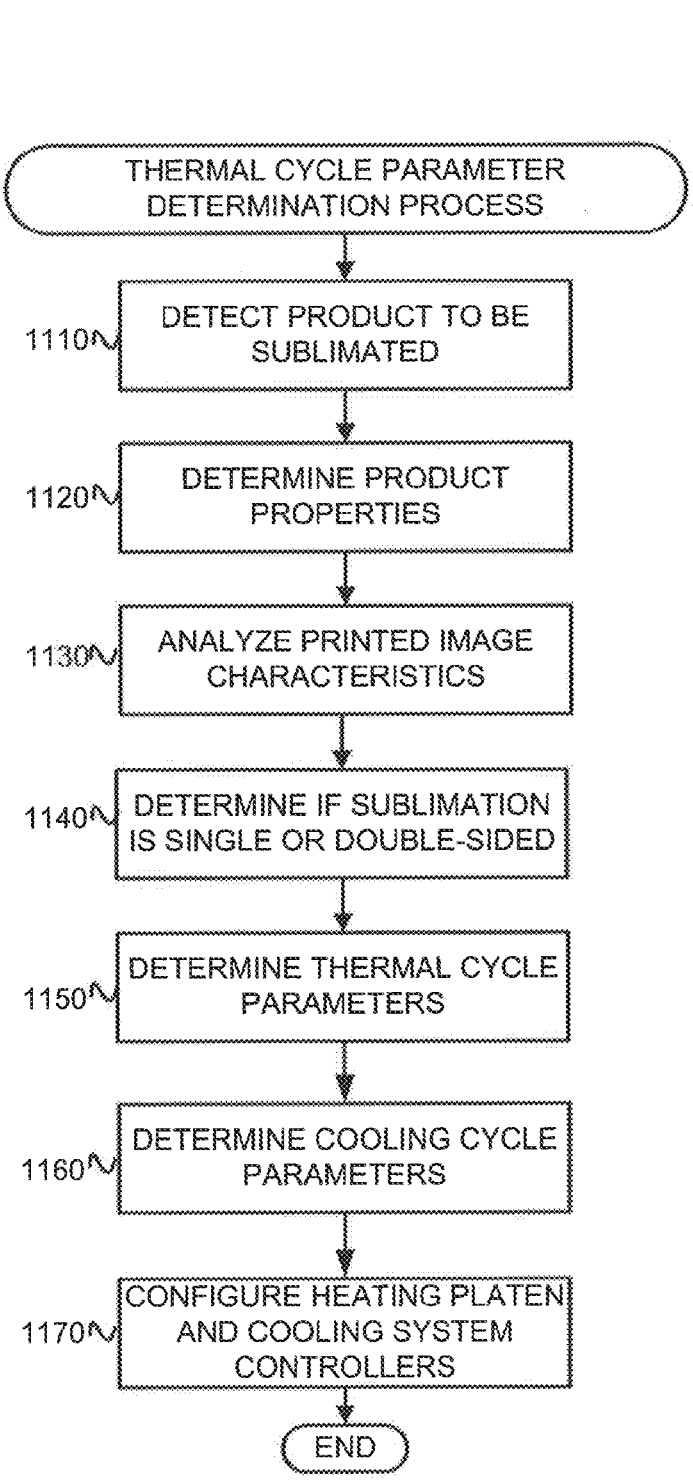
FIG. 11 is a flowchart of an exemplary thermal cycle parameter determination process, consistent with disclosed embodiments.

FIG. 11 is a flowchart illustrating an exemplary thermal cycle parameter determination process, as briefly described above. FIG. 11 will be described in connection with dye sublimation printing system 100, but it is understood that other configurations are within the scope of the invention, such as that illustrated in FIGS. 3 and 4 as dye sublimation printing system 300. In one embodiment, system 100 may detect the product to be sublimated (Step 1110). In some embodiments, system 100 may detect the product via a received input from a user interface device indicating a selection of the product by a user. As discussed above, in other embodiments, system 100 may identify and detect the product based on indicia printed on the product or on packaging accompanying the product. The indicia may constitute machine-readable barcodes, printed patterns, QR codes, etc. In some embodiments, the indicia may be directly read by an optical scanner associated with the machine vision tracking system. In other embodiments, the indicia may be captured by a camera and analyzed and confirmed via software. In some embodiments, substrate 10 or staging position 12 may include an optical scanner or other detection systems, and may transmit an indication to a user interface device indicating the selected product.

System 100 may determine properties of the detected product (Step 1120). The properties of the product may include, but not be limited to, the size and dimensions of the product and the material comprising the product (including information such as the material's melting point, sublimation point, etc.). As discussed above, determination of the detected product dimensions may be utilized for the printing of fiducial marks on the transfer media to assist with proper alignment and registration of the product and the media. In some embodiments, system 100 may additionally determine thermal characteristics of the product, such as its glass transition temperature. For products comprised of a composite material, system 100 may determine heat capacity, thermal conductivity, density, and mass of the composite material as a whole. As discussed above, information relating to the properties of the product may be included in stored information associated with the indicia found on the product. In other embodiments, the user interface device may prompt the user to input information relating to the properties of the product. In other embodiments, the user interface device may access information relating to the properties of the product from an included memory device. Alternatively, the user interface device may be configured to access product property information from a remote source, such as a network server accessible via the internet.

System 100 may analyze characteristics of the images to be printed onto the transfer media (Step 1130). Printer 2 may include hardware and software components configured to analyze the images, or alternatively, the user interface device may be configured to analyze them. The image characteristics may include, but are not limited to, information relating to the colors present in the image(s) and the pixel intensity of one or more regions of the image(s). In some embodiments, the pixel intensity may be scaled or normalized across the image, or across a region of the image.

System 100 may determine whether the sublimation task is intended to be single-sided (e.g. only on the top side of a product), or double-sided (Step 1140). As discussed above, whether the task is single-sided or double-sided may impact both the temperature configured for heating platen 14 by its control unit as well as the duration of the thermal cycle. System 100 may determine the number of product sides to sublimate in various ways. For example, in embodiments including a user interface device, the device may prompt the operator visually or audibly to select a single-sided or double-sided sublimation. Alternatively, optical sensors and/or machine vision tracking systems may determine the number of sides of the product to sublimate based on fiducial markers printed on the transfer media and/or indicia printed on packaging of the product to be sublimated. In other embodiments, printer 2 or printer 30 may be configured to communicate to a control unit for heating platen 14 that only one image was printed on the transfer media, and thus only one side of the product is to be sublimated. In still other embodiments, optical sensors and/or machine vision tracking systems may be configured to detect the number of images printed on the transfer media, and thus the number of sides to sublimate.

Process 1100 continues with system 100 determining parameters for the sublimation thermal cycle based on one or more of the detected product, the determined product properties, and the analyzed image characteristics (Step 1150). The parameters may include, but are not limited to, one or more of the heating temperature of the single thermal cycle, the duration of the thermal cycle, and the pressure exerted in the thermal cycle. As discussed above, the parameters may also be altered depending on whether the sublimation is to be single-sided or double-sided. The parameters may be determined based on reference materials loaded into memory of the user interface device, or may be determined based on information located on a remote server. In some embodiments, the parameter set for the single thermal cycle may be determined based on parameters used in similar sublimation tasks, e.g. tasks employing the same product, a product comprised of the same materials, a product comprising materials with similar properties, or images with similar characteristics. In these embodiments, the user interface device may be configured to store thermal cycle parameter information for each sublimation task completed by system 100. Properties of the product that system 100 may detect and consider in determining the thermal cycle parameters include dimensions of the product, materials comprising the product, and thermal characteristics, such as heat capacity, thermal conductivity, melting temperature, or glass transition temperature.

System 100 may further determine parameters for a cooling cycle based on one or more of the detected product and the determined product properties (Step 1160). The parameters may include, but are not limited to, one or more of the method of cooling (e.g. active cooling versus passive cooling) and the duration of the cooling cycle. As discussed above, the parameters may also be altered depending on whether the sublimation is to be single-sided or double-sided. Products sublimated on multiple sides may require additional cooling time since heat necessarily is transferred through the entire thickness of the product during the double-sided sublimation. The parameters may be determined based on reference materials loaded into memory of the user interface device, or may be determined based on information located on a remote server. In some embodiments, the parameter set for the single thermal cycle may be determined based on parameters used in similar sublimation tasks, e.g. tasks employing the same product, a product comprised of the same materials, or a product comprising materials with similar properties. In these embodiments, the user interface device may be configured to store cooling cycle parameter information for each sublimation task completed by system 100.

System 100 may configure hardware associated with the system to control a heating platen, such as heating platen 14, and a cooling system, such as cooling system 18 (Step 1170). In some embodiments, the parameters for the single thermal cycle may include one or more of the parameters determined in Steps 1150 and 1160, such as the temperature, duration, and pressure of the thermal cycle, or the method and duration of the cooling cycle. In some embodiments, one or more heating platens associated with the system may be configured to provide differential heating, as discussed above in association with FIG. 6. Regions of the heating platen, such as heating platen 14, may thus be configured and controlled to provide different temperatures in one or more regions of the platen, or to execute the thermal cycle at the same temperature, but for different durations in one region compared to another. In some embodiments, heating platen 14 may be configured to exert differential heating across the surface of the platen depending on properties of the product; for example, if dimensions of the product differ in one part of the product versus another. In other embodiments, heating platen 14 may be configured to exert differential heating across the surface of the platen based on image characteristics; for example, if one region of the image printed by printer 2 contains a plurality of pixels having a higher intensity than pixels in another region.

Figure 8:
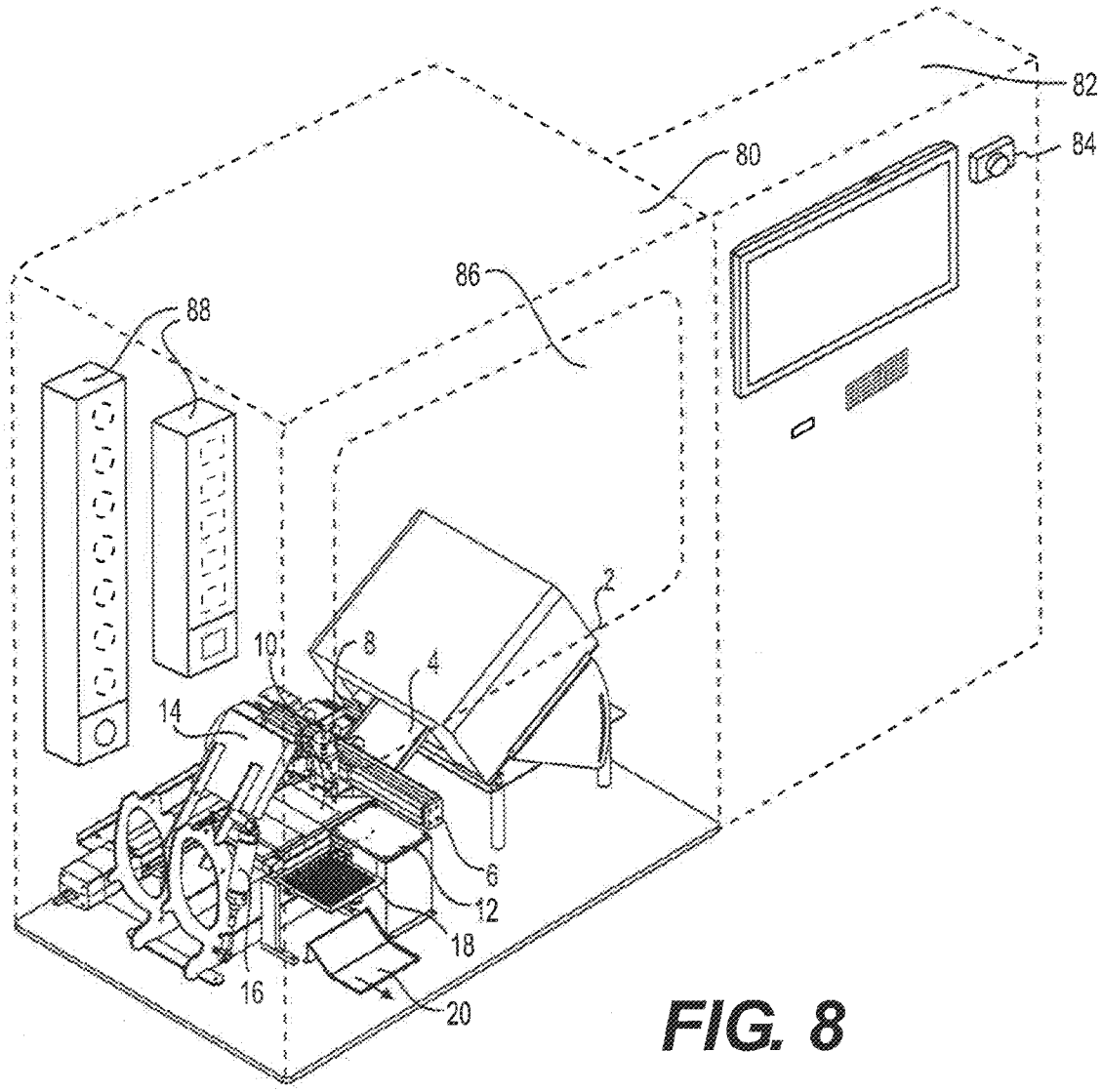
FIG. 8 is a diagrammatic illustration of an exemplary integrated dye sublimation transfer printing vending machine consistent with disclosed embodiments.

FIG. 8 illustrates the integration of an system 800 similar to system 100 or system 300 into a housing 80 configured to permit operation of the system in the manner of a vending machine. In the example shown in FIG. 8, a modified system 100 (a sheet-fed sublimation printer system) is situated within housing 80. Components of the system within the vending machine are substantially as described above and as depicted in FIGS. 1 and 2, with several additional features added to adapt the system to a fully automated, fully contained, integrated embodiment operable by an untrained consumer safely at a point of sale in a retail setting. For example, delivery opening 20 may be disposed relative to housing 80 such that a portion of the opening extends out from the housing, such that the consumer may retrieve the sublimated product. Additionally, printer 2 is configured to maintain a supply of a plurality of sheets of transfer media. Also included within housing 80 is one or more storage compartments 88, which may be configured to store a plurality of products of different types. Storage compartment 88 may be a magazine, configured to dispense products. Storage compartment 88 may include one or more openings to dispense one of the stored plurality of products when a particular product is selected by the user. Storage compartment 88 may be disposed within the housing such that it is adjacent or proximal to staging position 12, and in a manner such that transport mechanism 6 (including end effector 8) or some other mechanism may readily access storage compartment 88 to transport a selected product from storage compartment 88 to staging position 12. In some embodiments, storage compartment 88 may be movable, and may be configured to feed a product directly onto substrate 10 or staging position 12. In some embodiments, vending system 800 may contain multiple storage compartments 88. Each storage compartment may contain one type of a plurality of types of products. In other embodiments, one or more storage compartments 88 may be configured to store included accessories for sublimated products. Examples include, but are not limited to, key rings or key chains, covers or holders for luggage tags, frames, handles, etc. In some configurations, stand-alone accessories may also be contained in storage compartment 88, or may be introduced to the system by a user. Accessories may serve as value-added components that add to the aesthetics or utility of the sublimated product. The accessories themselves may or may not be sublimated. Accessories may or may not be dispensed at the same time as the sublimated product. For example, one user may customize both a sublimated product and a matching accessory. Another user might purchase and customize only a sublimated product. Finally, another user might purchase and customize a sublimated product, and return to vending system 800 at a later time to purchase one or more accompanying accessories for the product. As discussed above, the accessories may be pre-packaged, and inserted into vending system 800 by the user before, during, or after the sublimation of the product. When inserted, transport mechanism 6 may be configured to receive the inserted accessory and orient it within the system for the desired function.

Housing 80 may be configured as discussed above to include a control unit to regulate the temperature of heating platen 14. Maintaining heating platen 14 at a temperature intermediate of ambient temperature (e.g. 200 degrees Fahrenheit) and sublimation temperatures (e.g. 350 degrees Fahrenheit) allows for quick ramping up to a sublimation temperature. Housing 80 may further include ventilation components or systems. When present, these systems may interface with other ventilation systems in the retail establishment hosting vending system 800. The ventilation components may be configured to control a temperature within the housing such that the mechanical and electrical components of vending system 800 are protected from damage and the exterior surface of the housing remains touch-safe. Allowing the enclosed components, including heating platen 14, to remain at an intermediate but safe temperature reduces system warm-up time and customer wait time.

Vending system 800 may include a user interface device 82. User interface device 82 may be configured with various capabilities to facilitate the various steps of a sublimation task, including but not limited to those discussed above in relation to the interface device that is optionally associated with systems 100 and 300. User interface device 82 may include a variety of components to control other components of system 800. Device 82 may contain a computing system (not shown), which may further comprise one or more processors and one or more internal memory devices. The one or more processors may be associated with control elements of system 800 that position and operate the various components. The memory devices may store programs and instructions, or may contain databases. The memory devices may further store software relating to a graphical user interface, which device 82 may display to the user on an output screen. The computer system of user interface device 82 may also include one or more additional components that provide communications to other entities or systems via known methods, such as telephonic means or computing systems, including the Internet.

User interface device 82 may include input and output components to enable information associated with the sublimation task to be provided to a user, and also for the user to input required information. In some embodiments, the input components may include a physical or virtual keyboard. For example, in the example of FIG. 8, a consumer may first be prompted by device 82 to determine one or more images to be printed by printer 2 onto sheets of transfer media. Device 82 may be configured to receive a user-provided digital image file in various ways, including but not limited to receiving insertion of flash memory or a USB drive, connecting via a USB or Firewire® cable, receiving image files by email, receiving image files uploaded via a mobile application, retrieving user-submitted image files from an online library or website, etc.

In some embodiments, device 82 may be capable of outputting audible notifications or alerts to a customer or operator of vending system 800. For example, device 82, via transport mechanism 6 and/or substrate 10, may receive a notification that the transfer media is misaligned or jammed based on a lack of registration of a fiducial marker. In such a situation, device 82 may be configured to audibly output "PAPER MISFEED" and contact either an on-site or remote customer service representative via audio or visual cues (such as a flashing light) to fix the problem. In another embodiment, device 82 may be configured to tell the user to "LOOK AT THE SCREEN" when information is required from the user or important information is displayed for the user. In yet another embodiment, device 82 may be configured to audibly output "YOUR PRODUCT IS READY" when the sublimation process is complete and the product is cooled to a safe handling temperature. In some embodiments, the audio output capabilities of vending system 800 may extend to the input components. Device 82 may be configured such that key presses on a virtual keyboard or touchscreen associated with the device elicit confirmatory clicking noises. Additionally, the input components of device 82 may be configured to provide tactile or visual feedback to the user to indicate that an input member, such as a key of a keyboard, has been successfully pressed.

In some embodiments, user interface device 82 may include a camera 84, which can capture an image at the point of sale to utilize in the printing process and transmit the captured image to printer 2. Camera 84, in conjunction with networking capabilities of device 82, may enable a user in another physical location to perform remote diagnostics, maintenance, and calibration of vending system 800, as well as perform customer service functions to assist a user of the system. The memory of device 82 may contain a plurality of stock images for the consumer to choose from to supplement a user-supplied image or an image captured by camera 84. In some embodiments, device 82 may be configured to receive input of personal information from the consumer to be sublimated onto a product. Such personal information may include, but is not limited to, a name associated with the consumer, contact information, initials/monogramming, etc. Device 82 may be configured to generate an image including the received personal information. In some embodiments, device 82 may permit the consumer to select from a plurality of possible stock images to incorporate the personal information. In still other embodiments, device 82 may be configured to, at the selection of the consumer, synthesize the personal information into a selected stock image from the device memory, and provide the single synthesized image to printer 2 for printing onto transfer media. In other embodiments, device 82 may provide the consumer with the capability to select a product from storage compartment 88 for sublimation that is pre-printed with a stock image stored in the memory of device 82. Device 82 may be configured to store the received personal information as well as any personalized, synthesized, or stock images created or selected by the consumer. Further, device 82 may be configured to prompt the consumer for additional products that they may desire to have sublimated with the same image. Device 82 may be configured to transmit the stored consumer image to a remote network server, and may communicate an indication to the consumer information about additional sublimated or customized products that might be available for the consumer that can be printed and shipped from a remote location. The indication may be communicated to the consumer through various known means of communication, such as by telephone, email, social media, or on an internet webpage associated with one or more of the consumer, the retail outlet hosting vending system 800, or the maker of vending system 800. In some embodiments, device 82 may provide further options to the user, including customizing and purchasing accessories for the sublimated product, or configuring a delivery vehicle for the product. Device 82 may also be configured to prompt the user to select a companion accessory for the sublimated product. In some embodiments, the accessory also may be capable of sublimation by the system. In some embodiments, the user may be prompted to insert a desired accessory into the machine, or the accessory may be contained within the system. Device 82 may be configured to coordinate and collect payment for the accessory. In some embodiments, system 800 may be configured to utilize the used transfer media as a delivery vehicle for the sublimated product. In such embodiments, the transfer media may be preprinted on one or more sides with text or images associated with the retail outlet hosting vending system 800, or the maker of vending system 800.

Device 82 and camera 84 may be configured to allow interaction with vending system 800 by remote operators. Device 82 may be configured to include a "hot button" that when pressed, sends a notification to the remote operator asking for live video or audio contact with the operator of the system. In some embodiments, a remote technician may be capable of being notified by device 82, and able to view system components live through camera 84. Device 82 may be further configured to enable control by the remote technician, who could then perform service on vending system 800 such as clearing jammed transfer media, removing a stuck product from a magazine, retrieving a dropped accessory, etc. In other embodiments, device 82 and camera 84 may enable real-time customer service interactions with a user. When either a customer or an operator such as a store clerk have questions about the process or require assistance, a remote customer service representative may be contacted via device 82's hot button and can interact live with the customer. In some embodiments, device 82 may be configured to facilitate live video chat on an included display screen with the representative. In other embodiments, device 82 may be configured to facilitate live audio interaction with the representative, similar to a telephone call. In yet other embodiments, pressing the hot button may activate a text-based live chat, or send an email to the customer service representative. In some embodiments, the remote customer service may be a value-added service, as the service representative can assist a consumer in purchasing and customizing additional products and/or accessories.

Device 82 may be further configured to coordinate and collect payment for the sublimation task. The memory of device 82 may contain information relating to pricing for various types of the plurality of products. The pricing may vary by product, and may vary based on other predetermined criteria, such as the quantity of objects desired, image processing tasks completed, images acquired via camera 84, etc. Device 82 may display the pricing information on an output screen to the user. Device 82 may include, or be connected to, payment acceptance components that can accept cash, credit cards, or other payment methods from the consumer, such as a coupon, or a payment application on a mobile device. Device 82 may include a printer that can provide the consumer with a receipt of the payment transaction. In some embodiments, the receipt may also contain other information, such as an Internet URL for a website associated with either the retail outlet hosting vending system 800, or the maker of vending system 800 for purposes of additional possible products. Device 82 may be integrated into housing 80, or it may be disposed as a distinct device proximal to housing 80 but not integrated within it. It should be understood that a device similar to device 82, with any of the above configurations, may be provided as part of any system contemplated by this invention, whether in a vending or retail context or not.

Housing 80 may be configured to include at least one surface portion 86 comprised of a transparent material. The material may comprise, as non-limiting examples, acrylic, glass, fiberglass, plastic, or a hybrid material. Transparent surface portion 86 may be oriented in a manner that makes the components of the dye sublimation printer system, such as system 100, visible to a consumer or other operator while safely shielding the user from heat, pinch points, stored energy sources, and other such potential hazards associated with the operation of heavy machinery. Transparent surface portion 86 may provide entertainment and education to the user while the sublimation task is underway, and may also allow an operator to take note of components of the system requiring maintenance or repair. In some embodiments, transparent surface portion 86 may facilitate remote diagnostics, maintenance, and user assistance via the configured features of user interface device 82.

Figure 12:
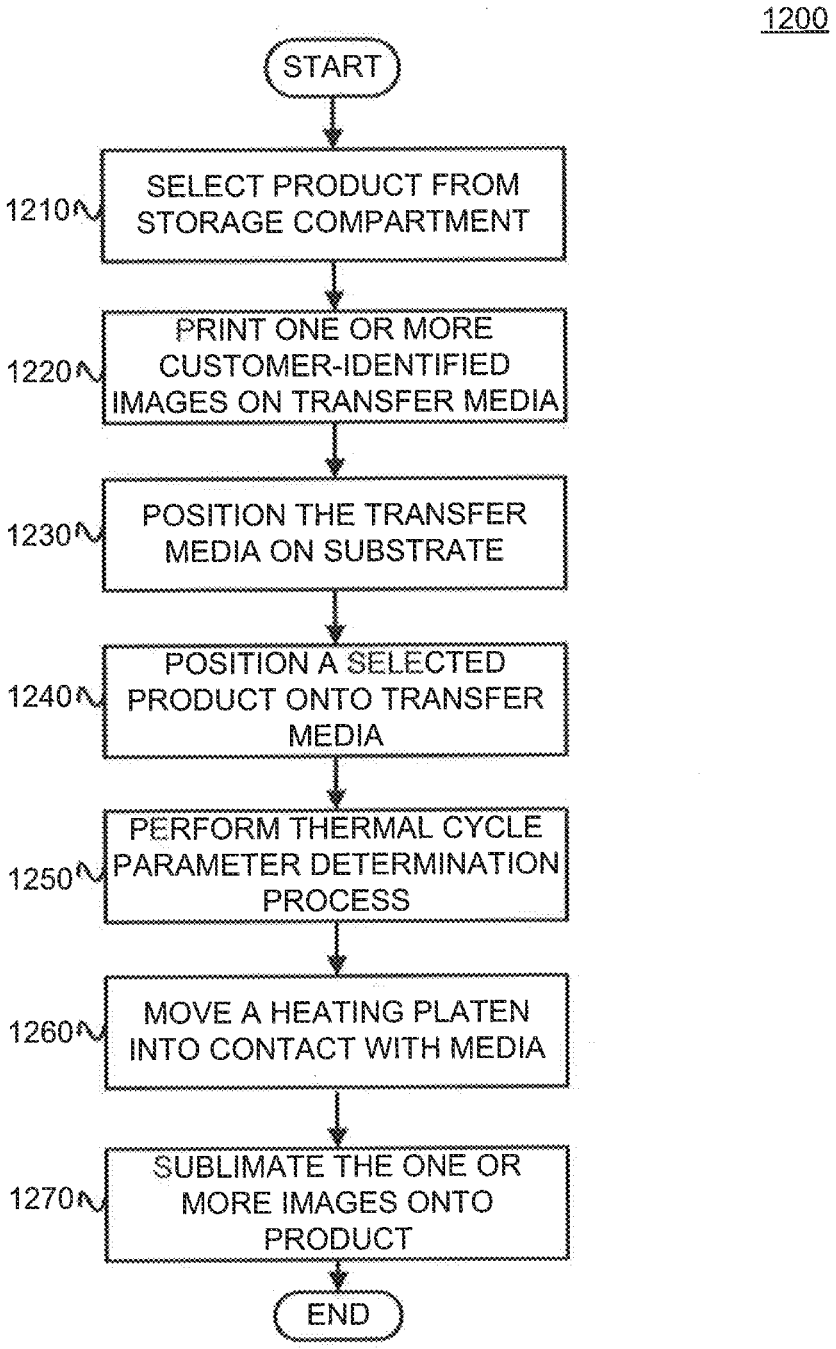
FIG. 12 is a flowchart of an exemplary dye sublimation transfer printing process, consistent with disclosed embodiments.

Vending system 800 may be configured to perform an automatic sublimated product customization process, such as that shown in the example of FIG. 12. In one embodiment, vending system 800 may be configured to select a product from a storage compartment, such as storage compartment 88 (Step 1210). Storage compartment 88 may be configured in some embodiments to contain a plurality of different products. User interface device 82 may be configured to prompt a consumer to pick one of the plurality of products stored in the storage compartment.

Vending system 800, via printer 2, may print one or more customer-identified images on a transfer media (Step 1220). In some embodiments, the image(s) may be a user provided digital image file received through user interface device 82. In other embodiments, the image file(s) may be stock image files preloaded into the memory of user interface device 82. In still other embodiments, the image file(s) may constitute text input received by device 82. In yet other embodiments, the image file(s) may be captured by camera 84. The image file(s) may also represent a combination or composite of the above described options. As discussed above, printer 2 may also be configured to print fiducial markers onto the transfer media along with the images. The user interface device may determine the dimensions of the product to be sublimated during the image printing process, and may control printer 2 to print fiducial markers in a particular place on the transfer media based on product dimensions.

Vending system 800 may position the transfer media onto a substrate, such as substrate 10 (Step 1230). As discussed above, in some embodiments, the transfer media may comprise sheets of transfer media that are deposited onto tray 4 after being printed by printer 2. In some embodiments, transport mechanism 6 may move the printed sheet of transfer media from tray 4 to substrate 10. As discussed, in alternative embodiments, vending system 800 may be configured to move the transfer media to substrate 10 in a variety of ways. Once placed in proximity to substrate 10, vending system 800 may position and align the transfer media on the substrate using one or more of the components described above, such as mechanical guides, mechanical switches, optical switches, machine vision systems, or a combination of one or more such components. In some embodiments the alignment may be assisted by recognition of fiducial markers by the machine vision tracking system.

Vending system 800 may position the selected product onto the transfer media (Step 1240). In some embodiments, the selected product is placed automatically by vending system 800 onto staging position 12, and then transport mechanism 6 (via end effector 8) transports the product from staging position 12 to substrate 10. Alignment of the selected product on the transfer media may also utilize one or more of the mechanical guides, mechanical switches, optical switches, and machine vision tracking systems described above. These systems will be described in further detail below in association with FIGS. 13-14. The selected product may be aligned onto one of the printed images on the transfer media. In some embodiments, transport mechanism 6, may further be configured to manipulate the transfer media to substantially surround the product, wherein at least one printed image is positioned on each side of the product.

Vending system 800 may be configured to perform a thermal cycle parameter determination process, to determine parameters of the single thermal cycle such as temperature, duration, and/or pressure (Step 1250). The thermal cycle parameter determination process may be process 1100 described above. As previously described, the determination of the temperature, duration, and/or pressure of the single thermal cycle, method of cooling, and cooling duration for a given product and image may be based upon constituent properties of the selected product and characteristics of the selected image. In some embodiments, user interface device 82 may be pre-configured to contain in memory information relating to properties of all products and/or accessories contained within storage compartment 88, such as the size of the product, the material comprising the product, etc. User interface device 82 may be configured to automatically update such information when products are added to or removed from storage compartment 88. Alternatively, user interface device 82 may be manually updated with new product property information. In these embodiments, the thermal cycle parameters can be automatically determined and configured in an instant, since device 82 can rapidly communicate property information associated with each of the plurality of products stored in storage compartment 88 to other components of vending system 800. Therefore, the same sublimation printing system may be configured to execute individual thermal cycles for back-to-back sublimation products with completely unique thermal cycle parameters. Additionally, if an accessory for a sublimated product requires sublimation printing itself, that accessory may be sublimated with unique thermal cycle parameters if the product and the accessory possess different properties. Similarly, user interface device 82 may be pre-configured to recognize and detect image characteristic data for any stock images stored in its memory that may be selected by a user, and may be configured to communicate that data to other components of vending system 800 for purposes of determining parameters for the single thermal cycle.

Process 1200 continues with vending system 800 moving one or more heating platens, such as heating platen 14, into contact with the transfer media (Step 1260) and sublimating the one or more printed images onto the product based on the determined single thermal cycle (Step 1270). After sublimating the image onto the selected product, in some embodiments vending system 800 may cool the printed product to at least about an ambient temperature before dispensing the sublimated product. Vending system 800 may cool the product using an optionally-equipped cooling system 18 and the cooling cycle determined in Step 1250. In some embodiments, vending system 800 may coordinate and receive payment for the sublimated product via user interface device 82. As discussed above, vending system 800 may be configured to limit consumer access to the sublimated product via delivery opening 20 until the product has cooled, payment has been received, or both.

Figure 9B:
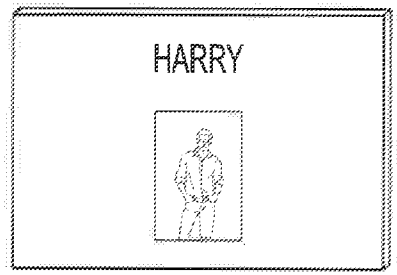
FIGS. 9A-9F are diagrammatic illustrations of customized images produced by an integrated dye sublimation transfer printing vending machine consistent with disclosed embodiments.
Figure 9C:
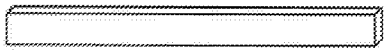
Figure 9D:
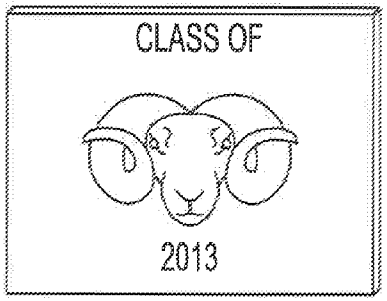
Figure 9F:
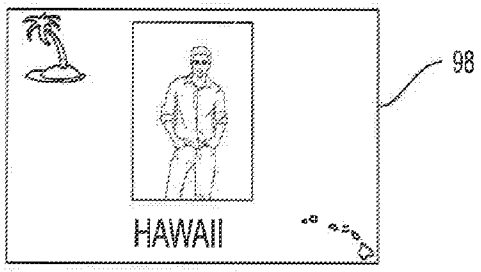
Figure 9A:
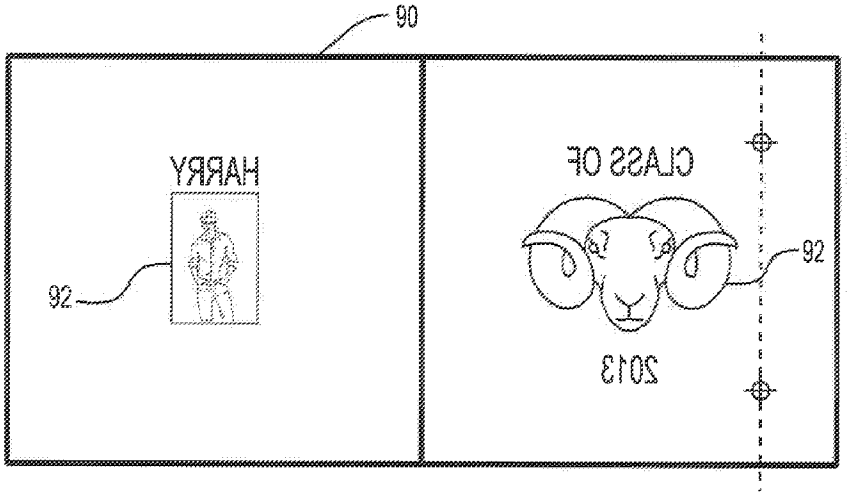

FIGS. 9A-9F illustrate exemplary images that may be associated with the systems described above in association with FIGS. 1-8. In FIG. 9A, a single sheet 90 of transfer media is shown, with printed images 92 printed (by a printer such as printer 2 or printer 30) onto either side of the bisecting feature. Image 92 is an example of an image that may be provided by a consumer. In some embodiments, the image(s) may be a user-provided image received through user interface device 82. In other embodiments, the image(s) may be stock images preloaded into the memory of user interface device 82. In still other embodiments, the image(s) may constitute text input received by device 82. In yet other embodiments, the image(s) may be captured by camera 84. The image(s) may also represent a combination or composite of the above described options. As discussed above, a printed sheet 90 such as that described in FIG. 9A would be aligned onto a substrate, such as substrate 10 or substrate 36, and engaged by one or more heating platens, such as heating platen 14 or heating platen 42, for sublimation onto one or more products. In some embodiments, as shown in FIG. 9A, images 92 may be mirrored by the system from their original orientation to facilitate simultaneous double-sided printing. Printers 2 and 30 may be configured to automatically process and invert one of the images 92 such that they may be printed in the mirrored fashion. In some embodiments, further processing may also be performed by the printer, such as offsetting the images 92 from one another to fit dimensions of a product, altering the size of an image 92, etc. FIG. 9A also illustrates printed fiducial markers to assist in alignment of sheet 90, as discussed above. FIGS. 9B, 9C, and 9D illustrate top, side, and bottom views, respectively, of a finished product that has been sublimated using the transfer media and images featured in FIG. 9A.

Figure 9E:
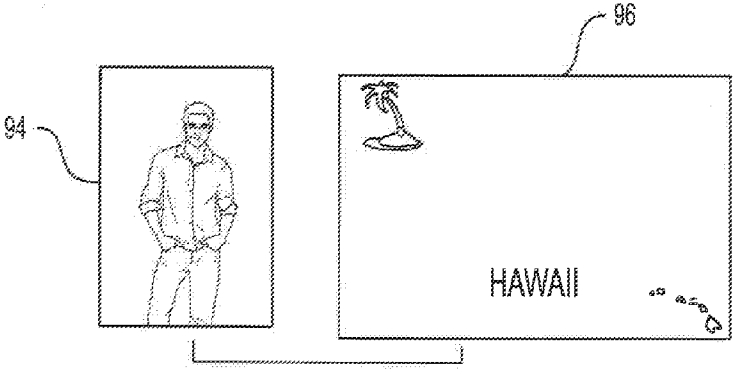

FIGS. 9E and 9F illustrate examples of a user-provided image 94, a stock image 96, and a synthesized image 98 as described above in relation to vending system 800. Image 94, like image 92, may represent either a consumer-supplied image or an image captured by camera 84. Image 96 may be an example of a stock image, contained in the memory of a user interface device such as device 82 of system 800. In the example of image 96, elements relating to a geographical destination, in this case, Hawaii, constitute the image. As discussed above, a consumer may opt, via device 82, to synthesize a consumer-provided image such as image 94 with a stock image, such as image 96, to create a synthesized image 98. The user interface device could then provide synthesized image 98 to a dye sublimation printer, such as printer 2 or printer 30, to print the image in preparation for sublimation. Of course, a consumer could alternatively select to print only image 94 onto a product, or only image 96. In still other embodiments, a consumer could opt to print a consumer-supplied image such as image 94 onto one surface of a product, and print a stock image like image 96 onto another surface. Other alternatives are possible, such as consumer-supplied image 94 and synthesized image 98 on opposing sides of a product, etc.

Figure 13:
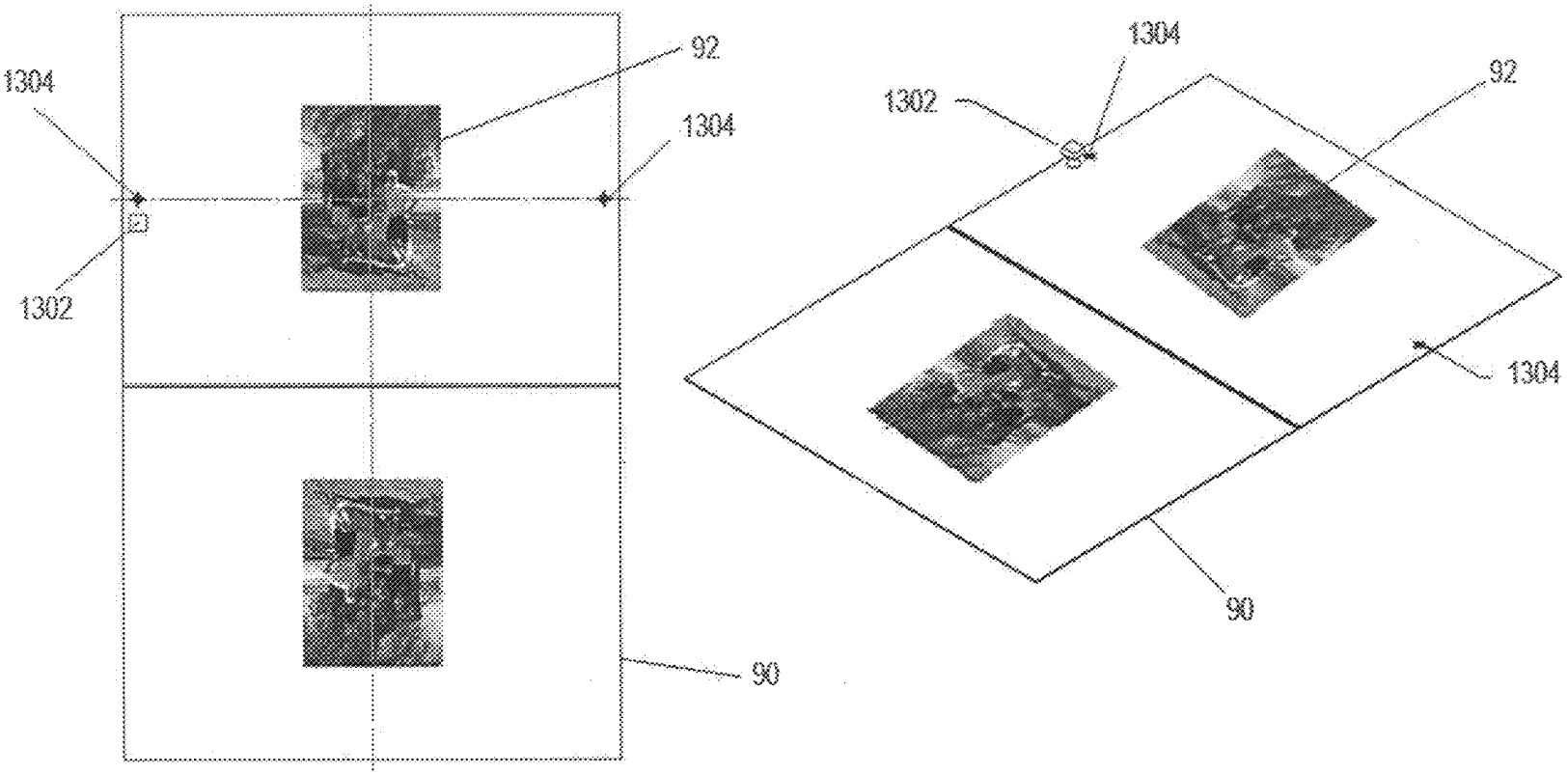
FIG. 13 is a diagrammatic illustration of optional registration and alignment features consistent with disclosed embodiments.

As discussed above, in some embodiments, the transfer media may contain one or more printed indicia and/or fiducial markers readable by the machine vision tracking system described previously to confirm location and orientation of the transfer media. An example of such an embodiment is illustrated in FIG. 13. Proper alignment of the transfer media in a sublimation printing system such as systems 100, 300, or 800 described above is particularly important when the system is configured to print on opposing sides of a product substantially simultaneously. Even a slight misplacement of the transfer media, and thus the printed images, may trigger a defective sublimated product.

FIG. 13 illustrates a top view and a perspective view of a sheet of transfer media with images printed on its surface, such as sheet 90 and images 92 described above in association with FIG. 9. In the example illustrated in FIG. 13, the sublimation system (which may be, for example, any one of systems 100, 300, or 800) may be equipped with a machine vision tracking system 1302. System 1302 may be substantially as described above, and may include one or more cameras, as well as one or more control units capable of executing software commands. System 1302 may be mounted in a fixed position on a transport mechanism, such as transport mechanism 6, or it may be configured to freely move along the mechanism. In the example of FIG. 13, sheet 90 has been printed with a set of fiducial markers 1304.

Tracking the location of the printed sheets of transfer media using the fiducial markers at all times within the system may be important to ensure quality of the image transfer and to prevent hazards, such as overheating of the transfer media. Even slight overheating of transfer media may create extremely unpleasant odors that could irritate the user and other surrounding customers. Therefore, the machine vision tracking system 1302 may be configured to confirm the location of a given sheet of transfer media such as sheet 90 in the system using visual confirmation or scanning means at set time periods, or when contact or non-contact sensors detect that sheet 90 has progressed to a new part of the system. The machine vision tracking system 1302 may determine that sheet 90 is susceptible to overheating and preemptively act to de-energize the heating platen and request service. This process may occur, for example, when the machine vision tracking system 1302 determines that the media and heating platen have been in contact for a time period exceeding a predetermined threshold value. The predetermined threshold value may be based on the temperature of the platen or properties of the product being sublimated.

The fiducial markers 1304 may also serve as indicators of the performance of the system; if the system senses via the markers that the transfer media is being consistently misaligned, hung up, or otherwise not moved smoothly through the system, it may indicate that the system requires maintenance. Markers 1304 may constitute machine-readable barcodes, printed patterns, QR codes, etc. In some embodiments, markers 1304 may be directly read by machine vision tracking system 1302. In other embodiments, images of markers 1304 may be captured by a camera, which may or may not be part of system 1302, and the images may be analyzed and confirmed via software. Markers 1304 may be pre-printed on sheet 90, or they may be printed by printer 2 at the time images 92 are printed onto sheet 90. In some embodiments, the markers 1304 may constitute crosshairs, and one or more markers may be placed around the periphery of the printed image to assist with alignment tasks governed by transport mechanism 6 and substrate 10 as described.

In some embodiments, fiducial markers 1304 may be utilized by systems 100 or 300 to perform an automatic self-calibration process. A user interface device associated with the system may configure printer 2 to print calibration images onto transfer media. The calibration images may comprise a pattern readable by components of the system, such as machine vision tracking system 1302, as well as a set of fiducial markers 1304. Once printed, the transfer media bearing the calibration images may be transported from printer 2 to substrate 10 by transfer mechanism 6 and end effector 8, as described. Machine vision tracking system 1302 may be configured to track the alignment of the calibration images using fiducial markers 1304 as described above. System 1302 may be further configured to compare the location of markers 1304 (e.g., using coordinates) when the transfer media is aligned on substrate 10 to a predetermined set of coordinates associated with an "ideal" alignment, such as a "home" position, or a default configuration. System 1302 may be configured to determine offsets in each dimension using the calibration images on the transfer media. The offset information may be stored locally in a memory device associated with the user interface device, or the user interface device may be configured to transmit the information to a remote server. Systems 100 or 300 may be configured to automatically adjust the calibration of relevant components to correct the offsets, such as printer 2, transport mechanism 6, end effector 8, substrate 10, or machine vision tracking system 1302.

Figure 14:
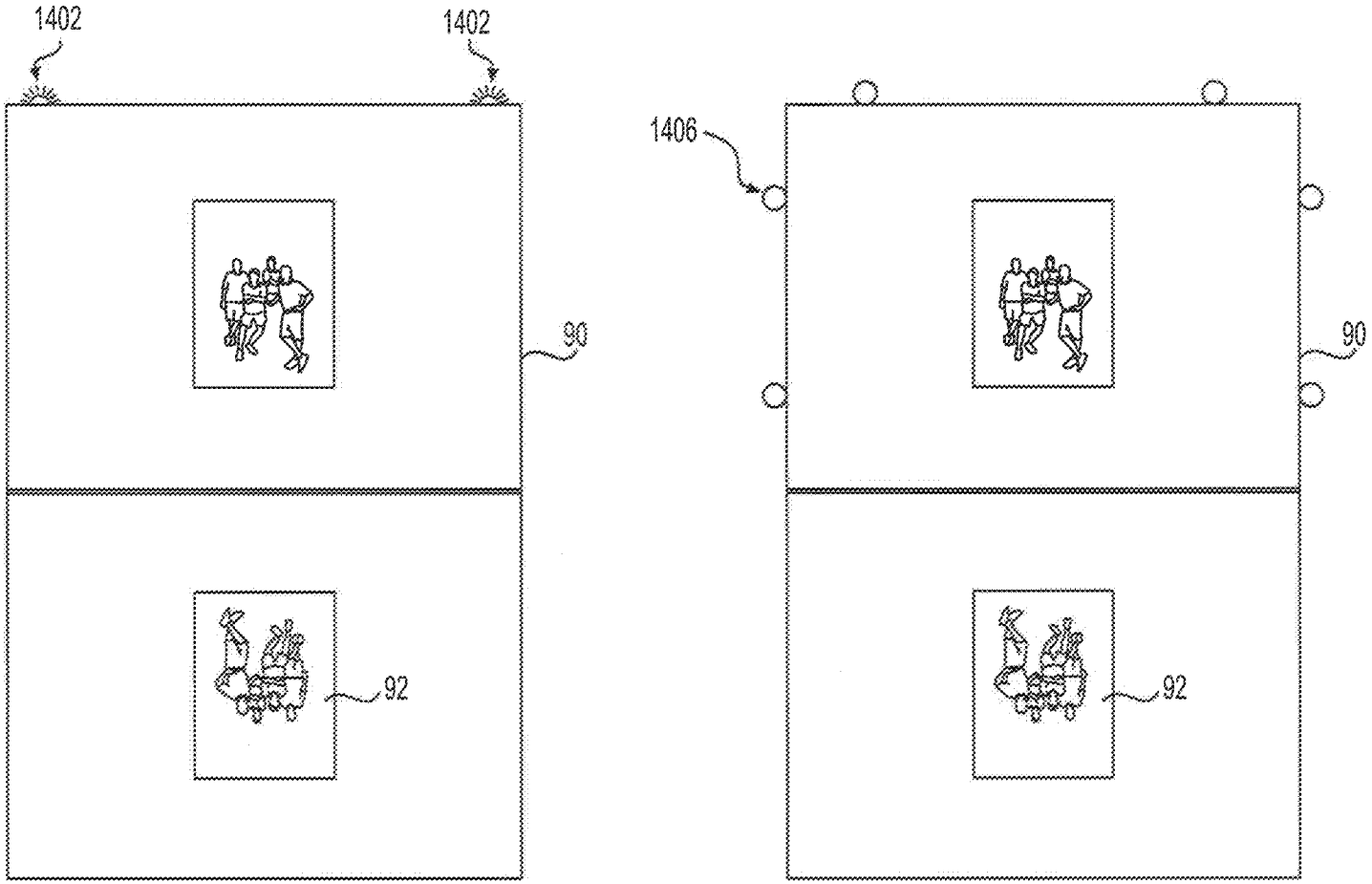
FIG. 14 is a diagrammatic illustration of optional registration and alignment features consistent with disclosed embodiments.

In some embodiments, as discussed above, alignment of the transfer media on the substrate of a disclosed system (such as substrate 10 or substrate 36) may be additionally facilitated by optional mechanical sensors and or non-contact sensors. Examples of such implements are illustrated in FIG. 14. As discussed above, proper alignment of the transfer media in a sublimation printing system such as systems 100, 300, or 800 described above is particularly important when the system is configured to print on opposing sides of a product substantially simultaneously.

Transport mechanism 6 and substrate 10 may include one or more non-contact sensors 1402 to aid in automatic transfer media and/or product alignment, orientation, and registration. Non-contact sensors within the scope of the invention include, but are not limited to, optical sensors, proximity sensors, or digital cameras, which may be mounted on any or all of transport mechanism 6, end effector 8, and substrate 10. For example, sensors 1402 may comprise light sources configured to provide through-beams of visible, infrared, or laser light that may indicate to an operator if the transfer media is properly aligned and registered on substrate 10. The indication may occur visually on substrate 10 or a nearby structure itself (for example, red and green LED lights, with the green light illuminating when the transfer media is properly aligned or past a certain location within the system), or may be transmitted to a user interface device and presented in a graphical user interface.

Non-contact sensors 1402 may be associated with one or more control units that control the motion of transport mechanism 6 and/or end effector 8, and may form part of an integrated, automated alignment system. For example, in some embodiments transport mechanism 6 may be configured to transport and align a sheet of printed transfer media from tray 4 to substrate 10. When configured to include non-contact sensors 1402, system 100 may be configured to control the extent of movement of transport mechanism 6. As described above, sensors 1402 may be configured to sense that the transfer media has passed over them, such as by breaking a through-beam, by sensing a change in optical clarity, or by a visual confirmation if sensors 1402 are configured to include a digital camera. When sensors 1402 are triggered, they may signal to the control unit controlling transport mechanism 6 and/or end effector 8 to immediately cease further forward motion of the transfer media onto the substrate. Sensors 1402 may be further configured to detect misalignment of the transfer media. For example, if the transfer media is placed on substrate 10 at a slight angle, sensors 1402 may be able to detect the error in the media placement and either signal to the control unit controlling transport mechanism 6 to take corrective measures, or signal to other software components to account for the misplacement during further operation of the system.

In other embodiments, substrate 10 may be disposed relative to tray 4 such that a series of mechanical guides assist in the placement of the transfer media. For example, tray 4 may be configured to form a funnel shape, such that the transfer media can only approach substrate 10 in a predetermined manner. Substrate 10 may be fitted with guide rails or other such stationary mechanical implements to position and align the transfer media and/or products, such as mechanical implements 1406. Such mechanical implements may be disposed under the immediate surface of substrate 10, and may be situated in holes or divots in substrate 10. In some embodiments, mechanical implements 1406 may be retractable, and are only visible and engaged while aligning and positioning the transfer media.

In some embodiments, implements 1406 may be configured as mechanical switches that provide guidance for orientation and alignment of the transfer media. In these embodiments, implements 1406 may serve as stops for the transfer media, such that when an edge of the media hits the switch, system 100 automatically stops moving the media in that direction. In other embodiments, implements 1406 may be configured to serve as gates, and may be retractable. The transfer media may be fed or transported over top of implements 1406, then positioned in the X-Y dimension once beyond them.

The systems and methods of the disclosed embodiments enhance the versatility and user-friendliness of a sublimation printing system in a retail environment. The current system provides a system with capabilities to make instant, automatic adjustments to a sublimation thermal cycle based on specific properties of a selected product, with many possible products provided as options for selection in a single point-of-sale. The systems and methods of the invention also enable real-time optimization of sublimation parameters based on the characteristics of an image selected for printing by the user. Taken together, these features ensure higher quality sublimated products, rapid production of customized goods, and increased customer satisfaction. The automatic process also reduces training time for retail operators, enhances possible product offerings, and reduces equipment malfunction and wear.

Other embodiments of the invention will be apparent to those skilled in the art from consideration of the specification and practice of the invention disclosed herein. For example, the processes of FIGS. 10-12 are not limited to the sequences described above. Variations of these sequences, such as the removal and/or the addition of other process steps may be implemented without departing from the spirit and scope of the disclosed embodiments. It is intended that the specification and examples be considered as examples only, with a true scope and spirit of the invention being indicated by the following claims.

What is claimed is:

1. An automated system for sublimating an image on a product selected from a plurality of different products, comprising:

a dye sublimation printer electronically configured to receive a digital image file representing an image, the dye sublimation printer configured to print the received image;

a substrate configured to receive the selected product; and an interface device including one or more processors, wherein the interface device is configured to automatically determine a thermal cycle for sublimating the received image onto one or more surfaces of the selected product, the thermal cycle including a predetermined temperature and duration, wherein one or more of the temperature and duration of the thermal cycle are based upon one or more properties of the selected product.

2. The automated system of claim 1, wherein the interface device is further configured to automatically determine a pressure for the thermal cycle based upon the one or more properties of the product.

3. The automated system of claim 1, wherein the interface device is further configured to automatically determine one or more of the temperature and duration of the thermal cycle based upon characteristics of the received digital image file.

4. The automated system of claim 3, wherein the temperature is determined based upon colors present in the received digital image file, and the automated system is configured to provide differential heating based upon the colors.

5. The automated system of claim 3, wherein the characteristics include at least one of color and pixel intensity.

6. The automated system of claim 1, wherein the interface device is configured to present a user with a choice of the plurality of different products and allow the user to select the product.

7. The automated system of claim 1, wherein the automated system is configured to identify the selected product from indicia on the product.

8. The automated system of claim 1, wherein one or more of the temperature and duration is determined based upon both one or more properties of the product and one or more characteristics of the received digital image file.

9. The automated system of claim 2, wherein properties of the product include at least one of a dimension of the product, the thermal conductivity of the material comprising the product, the heat capacity of the material comprising the product, and the glass transition temperature of the material comprising the product.

10. The automated system of claim 1, further comprising a cooling system configured to cool the sublimated product to at least about an ambient temperature.

11. The automated system of claim 10, wherein the interface device is configured to automatically determine one or more of the method and duration of a cooling cycle based upon one or more properties of the selected product.

12. The automated system of claim 1, wherein the user interface device is further configured to determine the number of surfaces of the product to sublimate, and wherein one or more of the temperature and duration of the thermal cycle are altered based on the determination.

13. An automated vending system for sublimating an image on a product selected by a user from a plurality of different products, comprising:

a dye sublimation printer electronically configured to receive a digital image file representing an image from the user, the dye sublimation printer configured to print the received image;

a staging position configured to receive the selected product;

a storage compartment configured to store a plurality of products of different types;

a transport mechanism configured to transport a product selected by the user from the storage compartment to the staging position;

a housing substantially enclosing the dye sublimation printer, staging position, storage compartment, and transport mechanism in a manner that prevents a user from contacting the enclosed components; and an interface device including one or more processors, wherein the interface device is configured to allow the user to select a product from the storage compartment and automatically determine a thermal cycle for sublimating the received image onto one or more surfaces of the selected product, the thermal cycle including a predetermined temperature and duration, wherein one or more of the temperature and duration of the thermal cycle are based upon one or more properties of the selected product.

14. An automated computer-implemented method for sublimating one or more images on a product selected from a plurality of different products, comprising:

positioning a product selected from the plurality of different products onto a substrate;

determining, by a processor, at least one value corresponding to one or more of a temperature and a duration of a thermal cycle to sublimate the one or more images onto the selected product, wherein the determination is made based upon at least one of a property of the selected product or a characteristic of the one or more images; and sublimating the one or more images onto the product, wherein at least one of the temperature and duration of the thermal cycle are the values determined by the processor.

15. The method of claim 14, further comprising determining, by a processor, at least one value corresponding to a pressure for the thermal cycle, wherein the determination is made based upon one or more properties of the product.

16. The method of claim 14, wherein the characteristics include at least one of color and pixel intensity.

17. The method of claim 14, wherein the determination of one or more of the temperature and duration of the thermal cycle is made based upon both a property of the product and a characteristic of the image.

18. The method of claim 14, wherein properties of the product include at least one of a dimension of the product, the thermal conductivity of the material comprising the product, the heat capacity of the material comprising the product, and the glass transition temperature of the material comprising the product.

19. The method of claim 14, further comprising enhancing the received digital image file before printing, wherein enhancing the digital image file includes one or more of resizing, auto-sizing, rotating, reversing, translating, altering brightness, reducing blur, de-skewing, and cropping.

20. The method of claim 14, further comprising determining the number of surfaces of the product to sublimate, wherein one or more of the temperature and duration of the thermal cycle are altered based on the determination.

* * * * *